US008518620B2

(12) United States Patent
Dojo et al.

(10) Patent No.: US 8,518,620 B2
(45) Date of Patent: Aug. 27, 2013

(54) MAGNETIC TONER

(75) Inventors: Tadashi Dojo, Numazu (JP); Nene Dojo, Numazu (JP); Tomohisa Sano, Sunto-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/577,148

(22) PCT Filed: Oct. 28, 2004

(86) PCT No.: PCT/JP2004/016011

§ 371 (c)(1),
(2), (4) Date: Apr. 26, 2006

(87) PCT Pub. No.: WO2005/043251

PCT Pub. Date: May 12, 2005

(65) Prior Publication Data

US 2007/0072102 A1 Mar. 29, 2007

(30) Foreign Application Priority Data

Oct. 31, 2003 (JP) ..... 2003-372544

(51) Int. Cl.
*G03G 9/083* (2006.01)

(52) U.S. Cl.
USPC ..... 430/106.1; 430/109.4; 430/110.1; 430/110.3; 430/110.4

(58) Field of Classification Search
USPC ..... 430/110.1, 110.3, 110.4, 109.4, 106.1
See application file for complete search history.

(56) References Cited

U.S. PATENT DOCUMENTS

| | | | | |
|---|---|---|---|---|
| 4,789,613 | A * | 12/1988 | Ohtani et al. | 430/108.3 |
| 4,868,085 | A * | 9/1989 | Aita | 430/119.86 |
| 5,641,600 | A | 6/1997 | Kotaki et al. | 430/106.6 |
| 6,010,814 | A * | 1/2000 | Kotsugai et al. | 430/108.3 |
| 6,596,452 | B2 | 7/2003 | Magome et al. | 430/106.2 |
| 6,703,176 | B2 | 3/2004 | Naka et al. | 430/110.3 |
| 6,803,164 | B2 | 10/2004 | Mizoo et al. | 430/106.2 |
| 7,160,660 | B2 | 1/2007 | Dojo et al. | 430/106.1 |
| 2001/0020988 | A1 | 9/2001 | Ohgiichi et al. | 349/54 |
| 2002/0048713 | A1 | 4/2002 | Komoto et al. | 430/124 |

(Continued)

FOREIGN PATENT DOCUMENTS

| | | |
|---|---|---|
| CH | 1318775 | 10/2004 |
| EP | 1207433 | 5/2002 |

(Continued)

OTHER PUBLICATIONS

Chinese Office Action dated May 9, 2008 and English language translation thereof.

*Primary Examiner* — Peter Vajda
(74) *Attorney, Agent, or Firm* — Fitzpatrick, Cella, Harper & Scinto

(57) ABSTRACT

To provide a magnetic toner which: enables a stable image density to be obtained irrespective of a use environment; and exhibits excellent low-temperature fixability, little image deterioration upon fixation, high coloring power, and a reduced toner consumption. The present invention relates to a magnetic toner containing at least: a binder resin; and a magnetic body. The binder resin contains a polyester unit. The toner has a weight average particle size of 5.0 to 9.0 μm, a true specific gravity of 1.3 to 1.7 g/cm$^3$, and a saturated magnetization of 20 to 35 Am$^2$/kg in a magnetic field of 796 kA/m. The dielectric loss tangent (tan δ) of the toner satisfies (tan $\delta_H$−tan $\delta_L$)/tan $\delta_L \leqq 0.20$ at 100 kHz.

7 Claims, 2 Drawing Sheets

(56) References Cited

U.S. PATENT DOCUMENTS

| | | | | |
|---|---|---|---|---|
| 2002/0098433 | A1 | 7/2002 | Matsunaga et al. | 430/108.8 |
| 2003/0028312 | A1 | 2/2003 | Matsuoka et al. | 701/117 |
| 2003/0035603 | A1 | 2/2003 | Kaiser | 384/368 |
| 2003/0039909 | A1 * | 2/2003 | Sawada et al. | 430/108.6 |
| 2003/0044708 | A1 * | 3/2003 | Matsunaga et al. | 430/108.22 |
| 2003/0098431 | A1 | 5/2003 | Wu | 251/207 |

FOREIGN PATENT DOCUMENTS

| | | | |
|---|---|---|---|
| JP | 06-118700 | * | 4/1994 |
| JP | 10-221881 | | 8/1998 |
| JP | 11-295925 | | 10/1999 |
| JP | 2001-356526 | | 12/2001 |
| JP | 2002-214828 | | 7/2002 |
| JP | 2002-221813 | | 8/2002 |
| JP | 2002-229254 | | 8/2002 |
| JP | 2002-258512 | | 9/2002 |
| JP | 2002-258526 | | 9/2002 |
| JP | 2002-341598 | | 11/2002 |
| JP | 2002-341598 A | * | 11/2002 |
| JP | 2002-351128 | | 12/2002 |
| JP | 2003-84504 | | 3/2003 |
| JP | 2003-98746 | | 4/2003 |
| JP | 2003-195560 | | 7/2003 |

* cited by examiner

MAGNETIC TONER

TECHNICAL FIELD

This application claims priority from Japanese Patent Application No. 2003-372544 filed on Oct. 31, 2003, which is hereby incorporated by reference herein.

The present invention relates to a toner to be used for a recording method utilizing an electrophotographic method, an electrostatic recording method, an electrostatic printing method, or a toner jet recording method.

BACKGROUND ART

A conventionally known electrophotographic method involves: utilizing a photoconductive substance to form an electrical latent image on a photosensitive member with the aid of various means; developing the latent image with toner; transferring the toner image onto a transfer material such as paper as required; and fixing the toner image under heat, pressure, or heat and pressure, or by means of the vapor of a solvent to produce a toner image.

A magnetic one-component development system using magnetic toner is preferably used for a method involving development with toner because the system eliminates the need for a carrier and is advantageous of a reduction in size of an apparatus. A considerable amount of magnetic body in fine powder form is mixed with and dispersed into toner to be used for the magnetic one-component development system. The state of presence of the magnetic body greatly affects the fluidity and triboelectric chargeability of the toner.

When one attempts to reduce the particle size of magnetic toner to improve dot reproducibility and the like, the amount of a magnetic body to be added has been conventionally increased to maintain a good balance between charging property and magnetic property. In this case, however, the following problems occur. One problem is that the amount of a binder component in the toner is relatively reduced to inhibit low-temperature fixability. Another problem is that fluidity is apt to reduce in association with increases in the saturated magnetization and true specific gravity of the toner and napping in an aggregated state is apt to be formed on a toner carrier, so it becomes difficult to form an appropriate napping state. Therefore, the toner behaves as an aggregate upon development onto a latent image-bearing member. As a result, problems are apt to occur, which include image quality deterioration such as tailing, image quality deterioration in which an image is collapsed upon fixation owing to an increase in amount of toner mounted on a latent image, and an increase in consumption of the toner.

To cope with those problems, attempts have been made to control the dielectric property of magnetic toner for the purpose of improving the developability of the toner. For example, there has been known toner having a magnetic body with its dispersibility improved by adjusting a dielectric loss tangent (see, for example, Patent Document 1). In this case, however, the stabilization of charging property involved in an environmental fluctuation or in a change with time is not sufficient, for example, when the particle size of the toner is reduced or the amount of the magnetic body is reduced, although the toner has an effect on the stabilization of charging property in a certain environment.

There has been known a technique involving specifying a ratio between a dielectric loss tangent in a high-temperature region and a dielectric loss tangent in a low-temperature region to reduce a change in chargeability of toner due to an environment (see, for example, Patent Document 2). In this case, however, the environmental stability of magnetic toner and a reduction in consumption of the toner are not sufficient.

A one-component development system involves causing toner to pass through a gap between a developing sleeve and a regulating member so that the toner is charged. At this time, a large stress is applied to the toner, with the result that a problem, that is, so-called toner deterioration occurs. In the toner deterioration, a treatment agent subsequently externally added to a toner base particle is embedded in the toner base particle or desorbs from the toner base particle, or the toner base particle becomes chipped. If such deterioration proceeds, a charge amount reduces or the generated fine powder sticks to the developing sleeve or the regulating member when the toner is repeatedly used, so an image defect involved in insufficient charging is apt to occur. To prevent such phenomenon, attempts have been made to sphere magnetic toner to enhance surface smoothness, thereby improving the durability of the toner (see, for example, Patent Document 3). However, this method is also susceptible to improvement in terms of stabilization of charging property due to an environmental fluctuation or the like.

Patent Document 1: JP-A-10-221881
Patent Document 2: JP-A-06-118700
Patent Document 3: JP-A-11-295925

DISCLOSURE OF THE INVENTION

An object of the present invention is to provide a toner that has solved the above-described problems. To be specific, an object of the present invention is to provide a magnetic toner which: enables a stable image density to be obtained irrespective of a use environment; and exhibits excellent low-temperature fixability, little image deterioration upon fixation, high coloring power, and a reduced toner consumption.

The inventors of the present invention have found that magnetic toner excellent in low-temperature fixability and having stable charging property for a long time period irrespective of an environment can be obtained by specifying the true specific gravity, magnetization, and dielectric loss tangent of the toner and by controlling a toner shape, thereby completing the present invention.

That is, the present invention is as follows.

(1) A magnetic toner comprising magnetic toner base particles each containing at least a binder resin and a magnetic body, wherein:

(i) the binder resin contains a polyester unit;

(ii) the toner has a weight average particle size (D4) of 5.0 to 9.0 μm;

(iii) the toner has a true specific gravity of 1.3 to 1.7 g/cm$^3$;

(iv) the toner has a saturated magnetization of 20 to 35 Am$^2$/kg in a magnetic field of 796 kA/m;

(v) the toner contains 60 number % or more of toner having a circularity of 0.93 or more; and (vi) the dielectric loss tangent (tan δ) of the toner at 100 kHz satisfies the following formula (1).

[Formula 1]

$$(\tan\delta_H - \tan\delta_L)/\tan\delta_L \leqq 0.20 \quad (1)$$

[In the formula, tan $\delta_H$ represents a dielectric loss tangent of the toner at a glass transition temperature (° C.)+10° C. and tan $\delta_L$ represents a dielectric loss tangent of the toner at the glass transition temperature (° C.)−10° C.]

(2) A magnetic toner according to the above item (1), wherein the toner contains 75 number % or more of toner having a circularity of 0.93 or more.

(3) A magnetic toner according to the above item (1) or (2), wherein a dielectric loss tangent (tan δ) of the toner at 100 kHz and 40° C. is $2\times10^{-3}$ to $1\times10^{-2}$.

(4) A magnetic toner according to any one of the above items (1) to (3), wherein a dielectric constant of the toner at 100 kHz and 40° C. is 15 to 40 (pF/m).

(5) A magnetic toner according to any one of the above items (1) to (4), wherein the magnetic body has a number average particle size of 0.08 to 0.30 μm.

(6) A magnetic toner according to any one of the above items (1) to (5), further comprising 30 mass % or more of a component having a molecular weight of 10,000 or less in the molecular weight distribution of the toner.

(7) A magnetic toner according to any one of the above items (1) to (6), wherein the binder resin contains two or more kinds of resins different from each other in softening point.

(8) A magnetic toner according to any one of the above items (1) to (7), wherein: the toner is externally added with an inorganic fine powder; and the inorganic fine powder contains two or more kinds of metal oxides each having a number average particle size of 100 nm or less.

(9) A magnetic toner according to the above item (8), wherein the inorganic fine powder contains at least a metal oxide (I) having a dielectric constant larger than that of the toner by 5 pF/m or more and a metal oxide (II) having a dielectric constant smaller than that of the toner by 5 pF/m or more.

BEST MODE FOR CARRYING OUT THE INVENTION

Figure 1:
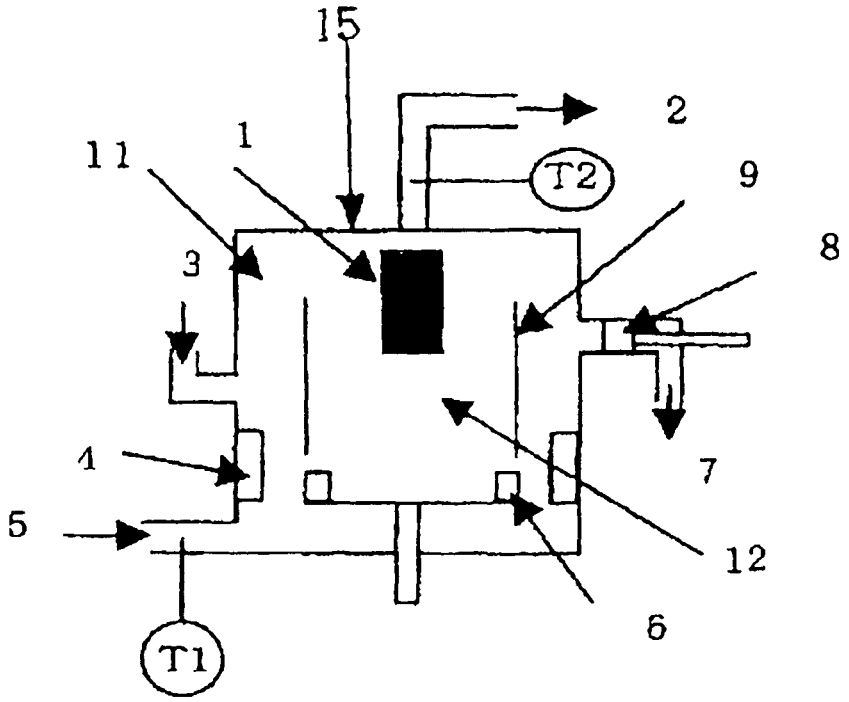
FIG. 1 is a schematic sectional view of a surface modification apparatus to be used in the present invention.

Hereinafter, the present invention will be described in detail.

The present invention relates to a magnetic toner comprising magnetic toner base particles each containing at least a binder resin and a magnetic body, wherein:

(i) the binder resin contains a polyester unit;

(ii) the toner has a weight average particle size (D4) of 5.0 to 9.0 μm;

(iii) the toner has a true specific gravity of 1.3 to 1.7 g/cm$^3$;

(iv) the toner has a saturated magnetization of 20 to 35 Am$^2$/kg in a magnetic field of 796 kA/m;

(v) the toner contains 60 number % or more of toner having a circularity of 0.93 or more; and (vi) the dielectric loss tangent (tan δ) of the toner at 100 kHz satisfies the following formula (1).

[Formula 2]

$$(\tan\delta_H-\tan\delta_L)/\tan\delta_L\leqq0.20 \quad (1)$$

[In the formula, tan $\delta_H$ represents the dielectric loss tangent of the toner at a glass transition temperature (° C.)+10° C. and tan $\delta_L$ represents the dielectric loss tangent of the toner at the glass transition temperature (° C.)−10° C.]

The value of the dielectric loss tangent of magnetic toner has been conventionally used as an indication of the ease with which the toner retains a charge amount. The lower the value, the higher the charge retaining ability of the toner.

Meanwhile, in the present invention, the value of a dielectric loss tangent is used as an indication of stability of charging property of toner in an electric field. In particular, the value of a dielectric loss tangent is used as an indication quantitatively showing the rate at which the charging property changes when an environment fluctuates in the developing process from a toner carrier to a latent image-bearing member, specifically when the temperature, the humidity, a bias to be applied, and the like change.

The research conducted by the inventors of the present invention has found that a rate of change in dielectric loss tangent around the glass transition temperature of toner has a strong correlation with a change in charging property due to a fluctuation in a development environment. According to the finding, the value of a dielectric loss tangent is mainly affected by the dispersed state of a colorant in toner, and, in particular, in the case of magnetic toner, the value is mainly affected by the dispersed state of a magnetic body. Comparison between materials having the same composition reveals that the value of a dielectric loss tangent can be reduced by improving the dispersibility of a magnetic body. In addition, the value of a dielectric loss tangent tends to increase with increasing temperature, and, in particular, a rate of change in dielectric loss tangent increases with decreasing amount of a magnetic body to be added. This is probably because the dispersed state of a magnetic body greatly affects the charging property as a result of a relative reduction in magnetic body content in toner. In view of the foregoing, in the present invention, a rate of change in dielectric loss tangent around the glass transition temperature of toner, that is, a rate of change in dielectric loss tangent between an ordinary state and a weakly molten state is used as an indication of development stability.

In the present invention, the dielectric loss tangent (tan δ) of the toner has only to satisfy the above formula (1), and preferably satisfies the following formula (2)

[Formula 3]

$$(\tan\delta_H-\tan\delta_L)/\tan\delta_L\leqq0.15 \quad (2)$$

[In the formula, tan $\delta_H$ represents the dielectric loss tangent of the toner at a glass transition temperature (° C.)+10° C. and tan $\delta_L$ represents the dielectric loss tangent of the toner at the glass transition temperature (° C.)−10° C.]

Here, the frequency as a standard for measuring a dielectric loss tangent is set to 100 kHz because the frequency is suitable for examining the dispersed state of a magnetic body. The reason why a frequency of 100 kHz is suitable is as follows. At a frequency lower than 100 kHz, the influence of the glass transition temperature of a binder resin increases. As a result, a rate of change in dielectric loss tangent around the glass transition temperature is so large that it becomes difficult to determine the dispersed state of the magnetic body. On the other hand, at a frequency higher than 100 kHz, a rate of change in dielectric loss tangent is so small that it becomes difficult to confirm the influence of the dispersibility of the magnetic body.

When the rate of change in dielectric loss tangent (tan $\delta_H$−tan $\delta_L$)/tan $\delta_L$ is larger than 0.20, the charging property of the toner is greatly affected by environmental fluctuations such as fluctuations in temperature, humidity, and development condition. Therefore, it is important that the rate of change be 0.20 or less.

The dispersed state of the magnetic body in the toner must be controlled in order to control the rate of change in dielectric loss tangent. Specific examples of improvements include improvements in a magnetic body such as a reduction in particle size of the magnetic body, control of the particle size distribution of the magnetic body, a mechanical treatment after the synthesis of the magnetic body to suppress magnetic aggregative ability, and coating of the magnetic body with an inorganic substance or an organic substance to improve fluidity. The examples further include improvements in the step of mixing raw materials upon toner production such as a reduction in grain size of a binder resin or a releasing agent and the lengthening of a mixing time. The examples further include: the control of the viscosity of a molten product through the adjustment of a kneading temperature to be equal to or higher than the softening point of the binder resin at the time of hot melt kneading; and the adjustment of a method of cooling a kneaded molten product at that time. The above methods may be used in combination.

In the present invention, the shape of the toner is preferably controlled in order to obtain additionally stable chargeability. The fact that the toner has a nearly completely spherical shape, in other words, an increase in circularity has several effects. In one effect, a uniform charge amount distribution can be easily obtained. As a result, so-called selective development in which a selective charge amount component involved in an environmental fluctuation and repeated use is consumed can be reduced, whereby a change in charge amount can be suppressed. In another effect, even when a stress between a developing sleeve and a regulating member is applied in a magnetic one-component development system, the contamination of a toner carrier due to a fine powder generated as a result of pulverization can be suppressed by reducing the amount of the fine powder. Achieving compatibility between such shape control and the above control of dielectric properties can provide toner having additionally stable charging property.

In the present invention, the above effects can be obtained by incorporating particles each having a relatively high circularity in the circularity distribution of toner (that is, 0.93 or more) into the toner at a predetermined ratio or higher.

In the present invention, it is preferable to incorporate 60 number % or more (more preferably, 75 number % or more) of toner having a circularity of 0.93 or more in the circularity distribution of the toner. When the ratio of the toner is smaller than 60 number %, repeated use for a long time period involves the emergence of phenomena such as a reduction in charge amount and the contamination of a developing sleeve, so a problem such as a reduction in image density is apt to occur.

In the present invention, the magnetic toner has a true specific gravity of 1.3 to 1.7 g/cm$^3$ and a saturated magnetization of 20 to 35 Am$^2$/kg in a magnetic field of 796 kA/m. When the true specific gravity is larger than 1.7 g/cm$^3$ or the saturated magnetization is larger than 35 Am$^2$/kg, in actuality, a relatively large amount of a magnetic body is often present in the toner, so an amount more than necessary of toner is apt to be developed owing to magnetic aggregative ability, with the result that problems such as image deterioration upon fixation and an increase in consumption occur and hence low-temperature fixability reduces. On the other hand, when the true specific gravity is smaller than 1.3 g/cm$^3$ or the saturated magnetization is smaller than 20 Am$^2$/kg, in actuality, a magnetic body content is often small, and an ability to form a nap on a toner carrier excessively reduces, so image quality is apt to deteriorate. In addition, the rate of change in dielectric loss tangent is so large that a change in charging property due to an environment increases.

The magnetic body content in the toner of the present invention is preferably 25 to 70 parts by mass, or more preferably 45 to 65 parts by mass with respect to 100 parts by mass of the binder resin.

In addition, the magnetic toner of the present invention has a weight average particle size (D4) adjusted to be within the range of 5.0 to 9.0 μm in order to faithfully develop a fine latent image dot to thereby improve image quality. A weight average particle size of the toner of less than 5.0 μm is not preferable because the amount of magnetic powder in one toner particle reduces to cause an increase in fogging. On the other hand, a weight average particle size of the toner in excess of 9.0 μm tends to make it difficult to improve image quality because the reproducibility of one dot deteriorates.

The binder resin in the present invention is a resin containing a polyester unit. Examples of the resin containing a polyester unit include a polyester resin and a hybrid resin in which a polyester unit and a styrene-acrylic resin unit chemically bind to each other. A mixture of each of those resins and any other resin is also available as a binder resin.

The polyester resin is originally excellent in sharp-melt property and is advantageous in terms of low-temperature fixability. In addition, the resin is excellent in dispersibility of a magnetic body in the hot melt kneading process upon toner production. In addition, the resin can make the dielectric constant of the toner relatively high, so it is suitable for controlling dielectric properties in the present invention.

The polyester resin is a resin produced by condensation polymerization of a polyhydric alcohol and a polybasic acid. Examples of a monomer for a polyester resin component include the following.

Examples of a dihydric alcohol component include ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, a bisphenol derivative represented by the following formula (i), and diols each represented by the following formula (ii).

[Compound 1]

(i)

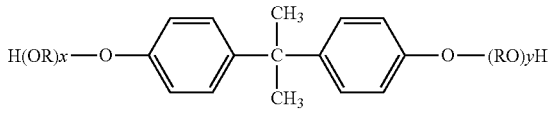

(In the formula, R represents an ethylene group or a propylene group, x and y each represent an integer of 1 or more, and the average value of x+y is 2 to 10.)

[Compound 2]

(ii)

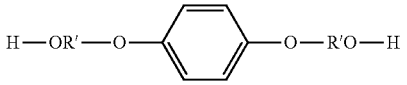

(In the formula, R' represents —$CH_2CH_2$—, —$CH_2$—CH($CH_3$)—, or —$CH_2$—C($CH_3$)$_2$—.)

Examples of a dicarboxylic acid include: benzenedicarboxylic acids or anhydrides thereof such as phthalic acid, terephthalic acid, isophthalic acid, and phthalic anhydride; alkyldicarboxylic acids such as succinic acid, adipic acid, sebacic acid, and azelaic acid, or anhydrides thereof; succinic acid or an anhydride thereof each substituted by an alkyl or alkenyl group having 6 to 18 carbon atoms; and unsaturated dicarboxylic acids such as fumaric acid, maleic acid, citraconic acid, and itaconic acid, or anhydrides thereof.

Examples of other monomers for the polyester resin include: polyhydric alcohols such as glycerin, pentaerythritol, sorbitol, sorbitan, and oxyalkylene ether of a novolac phenol resin; polyvalent carboxylic acids such as trimellitic acid, pyromellitic acid, and benzophenonetetracarboxylic acid, and anhydrides thereof.

An acid or alcohol component that can be used for producing the above polyester resin can be used as a monomer for producing the polyester unit in the hybrid resin. Examples of a vinyl-based monomer for producing a styrene-acrylic resin component include the following.

Examples of a styrene-based monomer include styrene and derivatives thereof such as: styrene; o-methylstyrene; m-methylstyrene; p-methylstyrene; p-phenylstyrene; p-ethylstyrene; 2,4-dimethylstyrene; p-n-butylstyrene; p-tert-butylstyrene; p-n-hexylstyrene; p-n-octylstyrene; p-n-nonylstyrene; p-n-decylstyrene; p-n-dodecylstyrene; p-methoxystyrene; p-chlorstyrene; 3,4-dichlorstyrene; m-nitrostyrene; o-nitrostyrene; and p-nitrostyrene.

Examples of an acrylic acid-based monomer include: acrylic acid and acrylates such as acrylic acid, methyl acrylate, ethyl acrylate, propyl acrylate, n-butyl acrylate, isobutyl acrylate, n-octyl acrylate, dodecyl acrylate, 2-ethylhexyl acrylate, stearyl acrylate, 2-chlorethyl acrylate, and phenyl acrylate; α-methylene aliphatic monocarboxylic acids and esters thereof such as methacrylic acid, methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; and acrylic acid or methacrylic acid derivatives such as acrylonitrile, methacrylonitrile, and acrylamide.

Examples of the monomer for producing a styrene-acrylic resin unit include: acrylates or methacrylates such as 2-hydroxyethyl acrylate, 2-hydroxyethyl methacrylate, and 2-hydroxypropyl methacrylate; and monomers each having a hydroxy group such as 4-(1-hydroxy-1-methylbutyl)styrene and 4-(1-hydroxy-1-methylhexyl)styrene.

Further, the styrene-acrylic resin unit can be used in combination with any one of various monomers each of which is capable of causing vinyl polymerization. Examples of such monomers include: ethylenically unsaturated monoolefins such as ethylene, propylene, butylene, and isobutylene; unsaturated polyenes such as butadiene and isoprene; vinyl halides such as vinyl chloride, vinylidene chloride, vinyl bromide, and vinyl fluoride; vinyl esters such as vinyl acetate, vinyl propionate, and vinyl benzoate; vinyl ethers such as vinyl methyl ether, vinyl ethyl ether, and vinyl isobutyl ether; vinyl ketones such as vinyl methyl ketone, vinyl hexyl ketone, and methyl isopropenyl ketone; N-vinyl compounds such as N-vinylpyrrole, N-vinylcarbazole, N-vinylindole, and N-vinylpyrrolidone; vinylnaphthalenes; unsaturated dibasic acids such as maleic acid, citraconic acid, itaconic acid, alkenylsuccinic acid, fumaric acid, and mesaconic acid; unsaturated dibasic acid anhydrides such as maleic anhydride, citraconic anhydride, itaconic anhydride, and alkenylsuccinic anhydride; half esters of unsaturated basic acids such as methyl maleate half ester, ethyl maleate half ester, butyl maleate half ester, methyl citraconate half ester, ethyl citraconate half ester, butyl citraconate half ester, methyl itaconate half ester, methyl alkenylsuccinate half ester, methyl fumarate half ester, and methyl mesaconate half ester; unsaturated basic esters such as dimethyl maleate and dimethyl fumarate; anhydrides of α,β-unsaturated acids such as acrylic acid, methacrylic acid, crotonic acid, and cinnamic acid; anhydrides of the α,β-unsaturated acids with lower aliphatic acids; and monomers each having a carboxyl group such as alkenylmalonic acid, alkenylglutaric acid, alkenyladipic acid, acid anhydrides thereof, and monoesters thereof.

In addition, the styrene-acrylic resin unit may be crosslinked with any one of such crosslinkable monomers as exemplified below as required. Examples of the crosslinkable monomers include: aromatic divinyl compounds; diacrylate compounds linked with an alkyl chain; diacrylate compounds linked with an alkyl chain containing an ether linkage; diacrylate compounds linked with a chain containing an aromatic group and an ether linkage; polyester-type diacrylates; and polyfunctional crosslinking agents. Examples of the aromatic divinyl compounds include divinylbenzene and divinylnaphthalene. Examples of the diacrylate compounds linked with an alkyl chain include ethylene-glycol diacrylate, 1,3-butylene glycol diacrylate, 1,4-butanediol diacrylate, 1,5-pentanediol diacrylate, 1,6-hexanediol diacrylate, and neopentyl glycol diacrylate, and those obtained by replacing the nacrylaten of each of the compounds with "methacrylate". Examples of the diacrylate compounds linked with an alkyl chain containing an ether linkage include diethylene glycol diacrylate, triethylene glycol diacrylate, tetraethylene glycol diacrylate, polyethylene glycol #400 diacrylate, polyethylene glycol #600 diacrylate, and dipropylene glycol diacrylate, and those obtained by replacing the "acrylate" of each of the compounds with "methacrylate". Examples of the diacrylate compounds linked with a chain containing an aromatic group and an ether linkage include polyoxyethylene(2)-2,2-bis(4-hydroxyphenyl)propane diacrylate and polyoxyethylene(4)-2,2-bis(4-hydroxyphenyl)propane diacrylate, and those obtained by replacing the "acrylate" of each of the compounds with "methacrylate". Examples of the polyester-type diacrylates include MANDA (trade name, manufactured by Nippon Kayaku Co., Ltd.). Examples of the polyfunctional crosslinking agents include: pentaerythritol triacrylate, trimethylolethane triacrylate, trimethylolpropane triacrylate, tetramethylolmethane tetraacrylate, oligoester acrylate, and those obtained by replacing the "acrylate" of each of the compounds with "methactylate"; and triallyl cyanurate and triallyl trimellitate.

Those crosslinkable monomers can be used in an amount of preferably 0.01 to 10 mass % (more preferably 0.03 to 5 mass %) with respect to 100 mass % of other monomer components. Of those crosslinkable monomers, aromatic divinyl compounds (especially divinylbenzene) and diacrylate compounds linked with a chain containing an aromatic group and an ether linkage can be exemplified as those suitably used in terms of fixability and offset resistance.

The styrene-acrylic resin unit may be a unit produced by means of a polymerization initiator. Examples of such polymerization initiator include: ketone peroxides such as 2,2'-azobisisobutyronitrile, 2,2'-azobis(4-methoxy-2,4-dimethylvaleronitrile), 2,2'-azobis(2,4-dimethylvaleronitrile), 2,2'-azobis(2-methylbutyronitrile), dimethyl-2,2'-azobisisobutyrate, 1,1'-azobis(1-cyclohexanecarbonitrile), 2-carbamoylazoisobutyronitrile, 2,2'-azobis(2,4,4-trimethylpentane), 2-phenylazo-2,4-dimethyl-4-methoxyvaleronitrile, 2,2'-azobis(2-methylpropane), methyl ethyl ketone peroxide, acetylacetone peroxide, and cyclohexanone peroxide; 2,2-bis(t-butylperoxy)butane; t-butyl hydroperoxide; cumene hydroperoxide; 1,1,3,3-tetramethylbutyl hydroperoxide; di-t-butyl peroxide; t-butylcumyl peroxide; dicumyl peroxide; α,α'-bis(t-butylperoxyisopropyl)benzene; isobutyl peroxide; octanoyl peroxide; decanoyl peroxide; lauroyl peroxide; 3,5,5-trimethylhexanoyl peroxide; benzoyl peroxide;

m-trioyl peroxide; diisopropyl peroxydicarbonate; di-2-ethylhexyl peroxydicarbonate; di-n-propyl peroxydicarbonate; di-2-ethoxyethyl peroxycarbonate; di-methoxyisopropyl peroxydicarbonate; di(3-methyl-3-methoxybutyl) peroxycarbonate; acetylcylohexylsulfonyl peroxide; t-butyl peroxyacetate; t-butyl peroxyisobutyrate; t-butyl peroxyneodecanoate; t-butyl peroxy-2-ethylhexanoate; t-butyl peroxylaurate; t-butyl peroxybenzoate; t-butyl peroxyisopropylcarbonate; di-t-butyl peroxyisophthalate; t-butyl peroxyallylcarbonate; t-amyl peroxy-2-ethylhexanoate; di-t-butyl peroxyhexahydrophthalate; and di-t-butyl peroxyazelate.

The hybrid resin is a resin in which a polyester unit and a styrene-acrylic resin unit chemically bind, directly or indirectly, to each other, and is constituted by the above polyester resin component, the above styrene-acrylic resin component, and a monomer component capable of reacting with both the resin components. Examples of a monomer capable of reacting with the styrene-acrylic resin unit out of the monomers constituting the polyester unit include unsaturated dicarboxylic acids such as fumaric acid, maleic acid, citraconic acid, and itaconic acid, or anhydrides thereof.

Examples of a monomer capable of reacting with the polyester resin unit out of the monomers constituting the styrene-acrylic resin unit include: monomers each having a carboxyl group or a hydroxyl group; and acrylates or methacrylates.

A preferable method of producing a hybrid resin involves subjecting at least one of the polyester resin and the styrene-acrylic resin described above to a polymerization reaction in the presence of a polymer containing a monomer component capable of reacting with each of the resins.

In the present invention, when a hybrid resin is used as a binder resin, the content of a polyester unit in the hybrid resin is 60 mass % or more, or preferably 80 mass % or more.

In the present invention, at least one of the polyester resin and the hybrid resin preferably contains a resin crosslinked with at least one of a polyvalent carboxylic acid which is trivalent or more and a polyhydric alcohol which is trihydric or more in order to achieve compatibility between low-temperature fixability and hot offset resistance.

In the present invention, 30 mass % or more of a low-molecular-weight component having a molecular weight of 10,000 or less is preferably incorporated. In addition, in the present invention, two or more kinds of polyester resins or hybrid resins having different softening points are desirably mixed in order to control the dispersibility of a magnetic body.

In the present invention, the binder resin to be fed in the step of mixing raw materials upon production preferably has a number average particle size of 300 μm or less in terms of the dispersibility of a magnetic body in toner base particles.

A conventionally known magnetic material is used as the magnetic body to be used in the toner of the present invention. Examples of the magnetic material in the magnetic toner include: iron oxides such as magnetite, maghemite, and ferrite, and iron oxides containing other metal oxides; metals such as Fe, Co, and Ni, and alloys of these metals with metals such as Al, Co, Cu, Pb, Mg, Ni, Sn, Zn, Sb, Be, Bi, Cd, Ca, Mn, Se, Ti, W, and V; and mixtures of them.

Specific examples thereof include triiron tetraoxide ($Fe_3O_4$), diiron trioxide ($\gamma$-$Fe_2O_3$), iron oxide zinc ($ZnFe_2O_4$), iron oxide yttrium ($Y_3Fe_5O_{12}$), iron oxide cadmium ($CdFe_2O_4$), iron oxide gadolinium ($Gd_3Fe_5O_{12}$), iron oxide copper ($CuFe_2O_4$), iron oxide lead ($PbFe_{12}O_{19}$), iron oxide nickel ($NiFe_2O_4$), iron oxide neodymium ($NdFe_2O_3$), iron oxide barium ($BaFe_{12}O_{19}$), iron oxide magnesium ($MgFe_2O_4$), iron oxide manganese ($MnFe_2O_4$), iron oxide lanthanum ($LaFeO_3$), an iron powder (Fe), a cobalt powder (Co), and a nickel powder (Ni). In the present invention, at least magnetic iron is incorporated as a magnetic material, and one or two or more kinds of other metals may be arbitrarily selected and used as required.

The magnetic properties of each of those magnetic materials in an applied magnetic field of 796 kA/m (10 kOe) preferably include an antimagnetic force of 1.5 kA/m to 12 kA/m, a saturated magnetization of 50 to 200 $Am^2/kg$ (preferably 50 to 100 $Am^2/kg$), and a remanent magnetization of 2 to 20 $Am^2/kg$. The magnetic properties of a magnetic material can be measured at 25° C. in an external magnetic field of 796 kA/m by means of a vibration type magnetometer such as a VSM P-1-10 (manufactured by TOEI INDUSTRY CO., LTD.).

The magnetic toner of the present invention preferably adopts a fine powder of magnetic iron oxide such as triiron tetraoxide or $\gamma$-diiron trioxide as a magnetic body.

In the present invention, the magnetic properties of a magnetic body and the amount of the magnetic body to be added are desirably controlled in such a manner that the toner has a saturated magnetization of 20 to 35 $Am^2/kg$ in a magnetic field of 796 kA/m.

In the present invention, the magnetic body preferably has a number average particle size of 0.08 μm to 0.30 μm. When the number average particle size is less than 0.08 μm, the magnetic body itself becomes reddish, so the tint of the toner also becomes reddish. In addition, fine dispersibility in a binder resin deteriorates to make it difficult to control a rate of change in dielectric loss tangent. On the other hand, when the number average particle size exceeds 0.30 μm, the coloring power of the toner reduces, and, in the case where a magnetic body content is small, a rate of change in dielectric loss tangent increases to make it difficult to control the dielectric loss tangent to satisfy the formula (1).

In the present invention, a dissimilar metal such as silicon or zinc or titanium is desirably incorporated into the inside and/or surface of the magnetic body. This is because the incorporation can reduce magnetic aggregative ability and improve the dispersibility of the magnetic body in the toner.

A mechanical share is preferably applied to the magnetic body of the present invention in a slurry state after the synthesis of the magnetic body to reduce the magnetic aggregative ability of the magnetic body. This is because such treatment can dramatically improve the fine dispersibility upon toner production.

In the present invention, any other colorant may be incorporated as required. At least one kind of carbon black and other conventionally known pigments and dyes can be used as a colorant.

In the present invention, other additives may be added to toner particles as required. Examples of such other additives include various additives conventionally known to be added into toner particles such as a releasing agent and a charge control agent.

Examples of the releasing agent include: aliphatic hydrocarbon-based waxes such as low-molecular-weight polyethylene, low-molecular-weight propylene, a microcrystalline wax, and a paraffin wax; oxides of aliphatic hydrocarbon-based waxes such as a polyethylene oxide wax, or block copolymers of the waxes; waxes mainly composed of fatty acid esters such as a carnauba wax, a sasol wax, and a montanic acid ester wax; partially or wholly deacidified fatty acid esters such as a deacidified carnauba wax; saturated straight-chain fatty acids such as palmitic acid, stearic acid, and montanic acid; unsaturated fatty acids such as brassidic acid, eleostearic acid, and parinaric acid; saturated alcohols such as stearyl alcohol, aralkyl alcohol, behenyl alcohol, carnaubyl alcohol, ceryl alcohol, and melissyl alcohol; polyhydric alcohols such as sorbitol; fatty amides such as linoleic amide, oleic amide, and lauric amide; saturated fatty bis amides such as methylene bis stearamide, ethylene bis capramide, ethylene bis lauramide, and hexamethylene bis stearamide; unsaturated fatty amides such as ethylene bis oleamide, hexamethylene bis oleamide, N,N'-dioleyl adipamide, and N,N'-dioleyl sebacamide; aromatic bis amides such as m-xylene bis stearamide and N—N'-distearyl isophthalamide; aliphatic metal salts (what are generally referred to as metallic soaps) such as calcium stearate, calcium laurate, zinc stearate, and magnesium stearate; waxes obtained by grafting aliphatic hydrocarbon-based waxes with vinyl-based monomers such as styrene and acrylic acid; partially esterified compounds of fatty acids and polyhydric alcohols such as behenic monoglyceride; methyl ester compounds each having a hydroxyl group obtained by, for example, hydrogenation of vegetable oil; and long-chain alkyl alcohols or long-chain alkyl carboxylic acids each having 12 or more carbon atoms.

Examples of a releasing agent to be particularly preferably used in the present invention include aliphatic hydrocarbon-based waxes. Examples of such aliphatic hydrocarbon-based waxes include: a low-molecular-weight alkylene polymer obtained by subjecting an alkylene to radical polymerization under high pressure or by polymerizing an alkylene under reduced pressure by means of a Ziegler catalyst; an alkylene polymer obtained by thermal decomposition of a high-molecular-weight alkylene polymer; a synthetic hydrocarbon wax obtained from a residue on distillation of a hydrocarbon obtained by means of an Age method from a synthetic gas containing carbon monoxide and hydrogen and a synthetic hydrocarbon wax obtained by hydrogenation of the gas; and those obtained by fractionating those aliphatic hydrocarbon-based waxes by means of a press sweating method, a solvent method, or vacuum distillation or according to a fractional crystallization system.

Examples of a hydrocarbon as a parent body of each of the above aliphatic hydrocarbon-based waxes include: one synthesized by a reaction between carbon monoxide and hydrogen using a metal oxide-based catalyst (a multiple system composed of two or more kinds in many cases) (such as a hydrocarbon compound synthesized by means of a synthol method or a hydrocol method (involving the use of a fluid catalyst bed)); a hydrocarbon having several hundred of carbon atoms obtained by means of an Age method (involving the use of an identification catalyst bed) with which a large amount of wax-like hydrocarbon can be obtained; and a hydrocarbon obtained by polymerizing an alkylene such as ethylene by means of a Ziegler catalyst. Of such hydrocarbons, in the present invention, a small, saturated, and long straight-chain hydrocarbon with a small number of branches is preferable, and a hydrocarbon synthesized by means of a method not involving the polymerization of an alkylene is particularly preferable because of its molecular weight distribution.

In the present invention, the releasing agent is preferably incorporated into toner particles in such a manner that an endothermic main peak appears in the region of 70 to 140° C. in a DSC curve obtained when toner particles each containing a releasing agent are measured with a differential scanning calorimeter in terms of the low-temperature fixability and hot offset resistance of the toner.

The endothermic peak temperature can be measured by means of a high-precision differential scanning calorimeter of an inner heat input compensation type such as a DSC-7 manufactured by Perkin Elmer Co., Ltd. in conformity with ASTM D 3418-82. The temperature at which the peak appears can be adjusted by means of a releasing agent with its melting point, glass transition point, degree of polymerization, and the like adequately adjusted. The DSC-7 is applicable to the measurement of temperatures showing thermophysical properties of toner particles and toner particle materials such as the glass transition point and softening point of a binder resin and the melting point of a wax as well as the peak temperature.

Specific examples of a wax that can be used as a releasing agent in the present invention include: Viscol (registered trademark) 330-P, 550-P, 660-P, and TS-200 (manufactured by Sanyo Chemical Industries, Ltd.); Hiwax 400P, 200P, 100P, 410P, 420P, 320P, 220P, 210P, and 110P (manufactured by Mitsui Chemicals, Inc.); Sasol H1, H2, C80, C105, and C77 (manufactured by Schumann Sasol); HNP-1, HNP-3, HNP-9, HNP-10, HNP-11, and HNP-12 (manufactured by NIPPON SEIRO CO., LTD); Unilin (registered trademark) 350, 425, 550, and 700 and Unicid (registered trademark), Unicid (registered trademark) 350, 425, 550, and 700 (manufactured by TOYO-PETROLITE); and a haze wax, a beeswax, a rice wax, a candelila wax, and a carnauba wax (available from CERARICA NODA Co., Ltd.).

The releasing agent is preferably incorporated into toner particles at a ratio of 2 to 15 parts by mass with respect to 100 parts by mass of the binder resin in terms of fixability and charging property.

A charge control agent may be used for the toner of the present invention to stabilize the chargeability of the toner. A charge control agent is generally incorporated into toner base particles in an amount of preferably 0.1 to 10 parts by mass, or more preferably 0.1 to 5 parts by mass with respect to 100 parts by mass of a binder resin, although the amount varies depending on, for example, the kind of the charge control agent and the physical properties of other materials constituting toner particles. Known examples of such charge control agent include one for controlling toner to be negatively chargeable and one for controlling toner to be positively chargeable. One or two or more kinds of various charge control agents can be used depending on the kind and applications of toner.

For example, an organometallic complex or a chelate compound is effective as a charge control agent for controlling toner to be negatively chargeable. Examples thereof include: monoazo metal complexes; acetylacetone metal complexes; metal complexes or metal salts of aromatic hydroxycarboxylic acids or aromatic dicarboxylic acids. The examples further include: aromatic monocarboxylic and polycarboxylic acids, and metal salts and anhydrates thereof; esters; and phenol derivatives such as bisphenol. Examples of a charge control agent for controlling toner to be positively chargeable include: nigrosine and modified products thereof with fatty acid metal salts, and so on; quaternary ammonium salts such as tributylbenzyl ammonium-1-hydroxy-4-naphtosulfonate and tetrabutyl ammonium tetrafluoroborate, and analogs thereof, which are onium salts such as phosphonium salts and lake pigments thereof; triphenyl methane dyes and lake pigments thereof (lake agents include phosphotungstenic acid, phosphomolybdic acid, phosphotungsten molybdic acid, tannic acid, lauric acid, gallic acid, ferricyanic acid, and ferrocyanide); metal salts of higher fatty acids; diorganotin oxides such as dibutyltin oxide, dioctyltin oxide, and dicyclohexyltin oxide; and diorganotin borates such as dibutyltin borate, dioctyltin borate, and dicyclohexyltin borate. In the present invention, each of them may be used alone, or two or more of them may be used in combination. Of those, a charge control agent for controlling toner to be positively chargeable made of a nigrosine-based compound, a quaternary ammonium salt, or the like is particularly preferably used.

More specifically, more preferable examples of a charge control agent for negative charging include: Spilon Black TRH, T-77, and T-95 (manufactured by Hodogaya Chemical Co., Ltd.); and BONTRON (registered trademark) S-34, S-44, S-54, E-84, E-88, and E-89 (manufactured by Orient Chemical Industries, LTD.). Preferable examples of a charge control agent for positive charging include: TP-302 and TP-415 (manufactured by Hodogaya Chemical Co., Ltd.); BONTRON (registered trademark) N-01, N-04, N-07, and P-51 (manufactured by Orient Chemical Industries, LTD.); and Copy Blue PR (manufactured by Clariant).

The toner of the present invention preferably uses a negatively chargeable charge control agent in terms of, for example, physical properties of toner materials. In particular, an azo-based iron complex such as T-77 is preferably used in terms of dispersibility of a magnetic body into a binder resin.

The toner of the present invention preferably has a dielectric loss tangent (tan δ) measured at a frequency of 100 kHz of $2\times10^{-3}$ to $1\times10^{-2}$. A dielectric loss tangent in this range provides good dispersibility of a magnetic body in the toner to facilitate the suppression of a fluctuation in charging property due to an environment. Furthermore, in the present invention, the dielectric constant of the toner at a frequency of 100 kHz and 40° C. is preferably 15 to 40 (pF/m).

Controlling the value of a dielectric loss tangent and a dielectric constant in this way can dramatically improve charging stability. A dielectric constant of less than 15 pF/m excessively increases the charge amount of the toner to make it difficult to provide stable image properties in a low-humidity environment or the like. On the other hand, a dielectric constant in excess of 40 pF/m delays the rise-up of charging of toner and facilitates the occurrence of a reduction in charge amount due to leaving.

The toner of the present invention is preferably externally added with any one of various materials in accordance with the kind of the toner before use.

Examples of an external additive include: a fluidity improver for improving the fluidity of toner such as an inorganic fine powder; and a conductive fine powder for adjusting the chargeability of the toner such as a metal oxide fine particle.

Examples of the fluidity improver include those capable of improving the fluidity of toner by being externally added to toner particles. Examples of such fluidity improvers include: a fluorine-based resin powder such as a vinylidene fluoride fine powder or a polytetrafluoroethylene fine powder; fine powdered silica such as silica obtained through a wet process or silica obtained through a dry process; fine powdered titanium oxide; fine powdered alumina; and treated silica, treated titanium oxide, and treated alumina obtained by subjecting the fine powdered silica, the fine powdered titanium oxide, and the fine powdered alumina to surface treatments with a silane coupling agent, a titanium coupling agent, silicone oil, and the like.

In the present invention, any such external additive as described above can be used, but an external additive having a number average particle size of 100 nm or less and containing at least two kinds of metal oxides is preferably used. It is more preferable that the additive contain a metal oxide (I) having a dielectric constant larger than that of the toner by 5 pF/m or more and a metal oxide (II) having a dielectric constant smaller than that of the toner by 5 pF/m or more.

When the number average particle size is larger than 100 nm, the additive is apt to be liberated from the surface of the toner, so an effect of the present invention is hardly obtained. In addition, when the dielectric constant of the metal oxide (I) is larger than that of the toner by less than 5 pF/m, toner aggregation is promoted by an electrostatic attraction between toner particles, so dot reproducibility tends to deteriorate. When the dielectric constant of the metal oxide (II) is smaller than that of the toner by less than 5 pF/m, an image density tends to reduce owing to a reduction in charge. Furthermore, the BET specific surface area of the metal oxide (II) is desirably 1.3 to 10 times as large as that of the metal oxide (I). This is because a ratio of the BET specific surface area of the metal oxide (II) to the BET specific surface area of the metal oxide (I) in this range causes an external additive having a high dielectric constant to significantly alleviate an electric field concentrating between toner particles and improves toner coverage with an external additive having a low dielectric constant, so toner sufficiently exerting the effect of the present invention can be obtained.

Titanium oxide fine particles are preferably used as a metal oxide having a number average particle size of 100 nm or less and a dielectric constant larger than that of the toner by 5 pF/m or more. Of the titanium oxide fine particles, fine particles each having a dielectric constant of 40 pF/m or more, or more preferably 100 pF/m or more, are preferably used because they have a significant alleviating effect on electrostatic aggregation in an electric field.

Titanium oxide fine particles obtained by: a sulfate method; a chlorine method; and low-temperature oxidation (thermal decomposition or hydrolysis) of volatile titanium compounds such as titanium alkoxide, titanium halide, and titanium acetylacetonate are used in the present invention. Any one of the crystal systems including anatase, rutile, a mixed crystal of them, and amorphous can be used.

The titanium oxide fine particles to be used in the present invention provide good results when they each have a specific surface area according to nitrogen adsorption measured by means of a BET method of 10 $m^2/g$ or more, or preferably 30 $m^2/g$ or more. A BET specific surface area of less than 10 $m^2/g$ is not preferable because of the following reason. In this case, the fluidity of the toner reduces and the titanium oxide fine particles are apt to be liberated from the toner particles. As a result, the liberated titanium oxide fine particles remain in a developing device in a large amount, or they adhere to various devices in an image forming apparatus, to promote the deterioration of image quality.

Hydrophobic titanium oxide fine particles to be used in the present invention each preferably have a volume resistivity of $10^8$ Ω·cm or more. A volume resistivity of less than $10^8$ Ω·cm is not preferable because titanium oxide serves as a leak site for charge to cause a significant reduction in charge amount, thereby causing fogging and the deterioration of image quality.

The titanium oxide fine particles to be used as the metal oxide (I) are preferably mixed in an amount of 0.01 to 5 parts by mass with respect to 100 parts by mass of toner base particles. A content of less than 0.01 part by mass hardly provides a suppressing effect on electrostatic aggregation. A content in excess of 5 parts by mass tends to excessively increase the fluidity of the toner, so uniform charging may be inhibited.

Examples of a method of producing hydrophobic titanium oxide fine particles that can be used in the present invention are shown below. However, the present invention is not particularly limited to these methods.

(a) A method involving: decomposing ilmenite as a starting material with sulfuric acid to prepare a solution; hydrolyzing the solution to produce metatitanic acid in a slurry state; adjusting the pH of the slurry of metatitanic acid; dropping and mixing a hydrophobizing agent for reaction while sufficiently dispersing the agent into a hydrogen medium in such a manner that metatitanic acid particles do not coalesce in the slurry; and filtering, drying, and shredding the resultant to produce hydrophobic titanium oxide fine particles.

(b) A method involving: blowing titanium tetraisopropoxide as a raw material little by little by means of a chemical pump to the glass wool of a vaporizer heated to about 200° C. with the aid of a nitrogen gas serving as a carrier gas to evaporate titanium tetraisopropoxide; instantaneously decomposing the resultant under heat in a reactor at about 300° C.; quenching the resultant to collect a product; baking the product at about 300° C. for about 2 hours; and subjecting the baked product to a hydrophobizing treatment to produce hydrophobic titanium oxide fine particles.

Such titanium oxide fine particles subjected to a hydrophobizing treatment as described above are preferably used in the present invention because they each have an increased affinity for a resin and can easily fix onto a toner surface when external added, so a suppressing effect on electrostatic aggregation can be easily exerted.

Examples of the hydrophobizing agent that can be used for titanium oxide fine particles include coupling agents such as a silane coupling agent, a titanate coupling agent, an aluminum coupling agent, and a zircoaluminate coupling agent.

Examples of the silane coupling agent include those each represented by the following general formula.

$R_mSiY_n$ [Compound 3]

[In the formula, R represents an alkoxy group, m represents an integer of 1 to 3, Y represents an alkyl group, a vinyl group, a phenyl group, a methacryl group, an amino group, an epoxy group, a mercapto group, or any one of the derivative of these groups, and n represents an integer of 1 to 3.]

Specific examples of the silane coupling agent include vinyltrimethoxysilane, vinyltriethoxysilane, γ-methacryloxypropyltrimethoxysilane, methyltrimethoxysilane, methyltriethoxysilane, isobutyltrimethoxysilane, dimethyldimethoxysilane, dimethyldiethoxysilane, trimethyltrimethoxysilane, hydroxypropyltrimethoxysilane, phenyltrimethoxysilane, n-hexadecyltrimethoxysilane, and n-octadecyltrimethoxysilane.

100 parts by mass of the titanium oxide fine particles are treated with preferably 1 to 60 parts by mass, or more preferably 3 to 50 parts by mass of the hydrophobizing agent.

A silane coupling agent particularly suitable in the present invention is an alkylalkoxysilane coupling agent represented by the following general formula.

$C_nH_{2n+1}—Si—(OC_mH_{2m+1})_3$ [Compound 4]

[In the formula, n represents an integer of 4 to 12, and m represents an integer of 1 to 3.]

The case where n in the alkylalkoxysilane coupling agent is smaller than 4 is not preferable because a hydrophobizing degree is low although a treatment can be easily performed. In the case where n is larger than 12, sufficient hydrophobicity can be obtained, but the coalescence of titanium oxide fine particles occurs frequently, so fluidity is apt to reduce and image quality may be adversely affected. When m is larger than 3, the reactivity of the alkylalkoxysilane coupling agent reduces to make it impossible to favorably perform a hydrophobizing treatment. In a more preferable alkylalkoxysilane coupling agent, n is 4 to 8 and m is 1 or 2.

As in the case of the amount of the hydrophobizing treatment with which the titanium oxide fine particles are to be treated, 100 parts by mass of the titanium oxide fine particles are treated with preferably 1 to 60 parts by mass, or more preferably 3 to 50 parts by mass of the alkylalkoxysilane coupling agent represented by the general formula.

A hydrophobizing treatment may be performed by means of one kind of hydrophobizing agent alone, or may be performed by means of two or more kinds of hydrophobizing agents. For example, a hydrophobizing treatment may be performed by means of one kind of coupling agent alone, or may be performed by means of two kinds of coupling agents simultaneously. Alternatively, a hydrophobizing treatment may be performed by means of a coupling agent, and an additional hydrophobizing treatment may be performed by means of another coupling agent.

Examples of a method of subjecting titanium oxide fine particles to a hydrophobizing treatment by means of a hydrophobizing agent include the following methods. However, the present invention is not limited to these methods.

(a) A method for a hydrophobizing treatment according to a wet process involving: adding a predetermined amount of a hydrophobizing agent, a diluent thereof, or a mixed liquid thereof while sufficiently and mechanically mixing and stirring it in a dispersion liquid containing a predetermined amount of metatitanic acid fine particles or of titanium oxide fine particles; additionally sufficiently mixing and stirring the mixture in such a manner that particles do not coalesce; and drying and shredding the resultant.

(b) A method for a hydrophobizing treatment according to a dry process involving: adding a predetermined amount of a hydrophobizing agent, a diluent thereof, or a mixed liquid thereof dropwise or by means of a spray while stirring a predetermined amount of titanium oxide fine particles by means of a device such as a blender; sufficiently mixing and stirring the mixture; adding an additional predetermined amount of a hydrophobizing agent, a diluent thereof, or a mixed liquid thereof to the mixture; sufficiently mixing and stirring the mixture; drying the resultant mixtures under heat; stirring the dried product by means of a device such as a blender; and shredding the resultant.

A substance having a low dielectric constant such as alumina or a silica fine particle can be used as a metal oxide having a number average particle size of 100 nm or less and a dielectric constant smaller than that of toner by 5 pF/m or more. In particular, a silica fine particle is suitably used for the toner of the present invention because it has a required dielectric constant and is excellent in charging stability of toner. Examples of the silica fine particle include: fine powdered silica such as silica obtained through a wet process or silica obtained through a dry process; and treated silica obtained by subjecting the fine powdered silica to a surface treatment with a silane coupling agent, a titanium coupling agent, silicone oil, or the like. Preferable silica fine particles are silica fine particles produced through the vapor phase oxidation of a silicon halide compound, the particles being called dry process silica or fumed silica. The dry process silica or fumed silica is produced by means of a conventionally known technique. For example, the production utilizes a thermal decomposition oxidation reaction in oxygen and hydrogen of a silicon tetrachloride gas, and a basic reaction formula for the reaction is represented by the following formula.

$SiCl_4+2H_2+O_2>SiO_2+4HCl$ [Compound 5]

A composite fine powder of silica and any other metal oxide can also be obtained by using a silicon halide compound with another metal halide compound such as aluminum chloride or titanium chloride in the production step, and silica comprehends the composite fine powder as well. A silica fine powder having an average particle size in the range of preferably 0.001 to 2 μm, or particularly preferably 0.002 to 0.2 μm is used.

Furthermore, treated silica fine particles subjected to a hydrophobizing treatment are preferably used as silica fine particles produced through the vapor phase oxidation of the silicon halide compound.

A silica fine particle is chemically treated with an organic silicon compound that reacts with or physically adsorbs to the silica fine particle, or the like to impart hydrophobicity to the silica fine particle. A preferable method involves treating silica fine particles produced through the vapor phase oxidation of a silicon halide compound with an organic silicon compound. Examples of such organic silicon compound include hexamethyl disilazane, trimethyl silane, trimethyl chlorosilane, trimethyl ethoxysilane, dimethyl dichlorosilane, methyl trichlorosilane, allyldimethyl chlorosilane, allylphenyl dichlorosilane, benzyldimethyl chlorosilane, bromomethyl dimethylchlorosilane, α-chloroethyl trichlorosilane, β-chloroethyl trichlorosilane, chloromethyl dimethylchlorosilane, triorganosilyl mercaptan, trimethylsilyl mercaptan, triorganosilyl acrylate, vinyldimethyl acetoxysilane, dimethylethoxy silane, dimethyldimethoxy silane, diphenyldiethoxy silane, 1-hexamethyl disiloxane, and 1,3-divinyl tetramethyl disiloxane. Each of them is used alone, or two or more of them are used as a mixture.

A silane coupling agent containing a nitrogen atom (such as aminopropyl trimethoxysilane, aminopropyl triethoxysilane, dimethylaminopropyl trimethoxysilane, diethylaminopropyl trimethoxysilane, dipropylaminopropyl trimethoxysilane, dibutylaminopropyl trimethoxysilane, monobutylaminopropyl trimethoxysilane, dioctylaminopropyl dimethoxysilane, dibutylaminopropyl dimethoxysilane, dibutylaminopropyl monomethoxysilane, dimethylaminophenyl triethoxysilane, trimethoxysilyl-γ-propylphenyl amine, or trimethoxysilyl-γ-propylbenzyl amine) is used alone or in combination. An example of a preferable silane coupling agent includes hexamethyldisilazane (HMDS).

The silica fine particles may be treated with silicone oil, or may be treated together with the above-described treatment agent for imparting hydrophobicity.

Silicone oil having a viscosity of 30 to 1,000 centistokes at 25° C. is preferably used. Examples of preferable silicone oil include dimethyl silicone oil, methylphenyl silicone oil, α-methylstyrene-denatured silicone oil, chlorophenyl silicone oil, and fluorine-denatured silicone oil.

Examples an available method for treatment with silicone oil include: a method involving directly mixing silica fine particles treated with a silane coupling agent and silicone oil by means of a mixer such as a Henschel mixer; a method involving spraying silica fine particles each serving as a base with silicone oil; and a method involving dissolving or dispersing silicone oil into an appropriate solvent and adding and mixing silica fine particles to and with the solution to remove the solvent. After having been treated with silicone oil, silica is more preferably heated at 200° C. or higher (more preferably 250° C. or higher) in an inert gas to stabilize the coat on the surface of silica.

In the external additive of the present invention, the amount of the metal oxide (I) to be added is preferably 0.1 to 10 times as large as the amount of the metal oxide (II) to be added. When the amount of the metal oxide (I) to be added is less than 0.1 time as large as the amount of the metal oxide (II) to be added, a substance having a low dielectric constant is present in an excessive amount, so the toner is apt to charge up. As a result, a dot tends to deteriorate and fogging tends to be remarkable. In contrast, when the amount of the metal oxide (I) to be added is more than 10 times as large as the amount of the metal oxide (II) to be added, the chargeability of the toner reduces, so an image density and the amount of the toner mounted on a latent image become insufficient.

The toner of the present invention may be added with external additives except the inorganic fine powder as required. The total amount of the external additives is preferably 0.1 to 5 parts by mass with respect to 100 parts by mass of the toner.

Examples of such external additives include resin fine particles and inorganic fine particles serving as charging adjuvants, conductivity imparting agents, fluidity imparting agents, caking inhibitors, releasing agents, lubricants, and abrasives except those described above. More specific examples thereof include: lubricants such as Teflon (registered trademark), zinc stearate, and polyvinylidene fluoride (of those, polyvinylidene fluoride is preferable); abrasives such as cerium oxide, silicon carbide, and strontium titanate (of those, strontium titanate is preferable); fluidity imparting agents such as aluminum oxide (of those, a fluidity imparting agent which is hydrophobic is particularly preferable); caking inhibitors; conductivity imparting agents such as carbon black, zinc oxide, antimony oxide, and tin oxide; and fine particles opposite in polarity.

A method of producing the toner of the present invention is not particularly limited. A preferable method involves: sufficiently mixing the binder resin and the magnetic body described above, and, as required, any other additive by means of a mixer such as a Henschel mixer or a ball mill; melting, kneading, and milling the mixture by means of a heat kneader such as a kneader or an extruder to make resins compatible with each other; cooling and solidifying the melt kneaded product; pulverizing the solidified product; classifying the pulverized pieces to produce toner base particles; and sufficiently mixing the toner base particles and an external additive by means of a mixer such as a Henschel mixer as required.

In the production of the toner of the present invention, the classification can be performed at an arbitrary time after the production of the toner base particles. For example, the classification may be performed after the mixing with an external additive.

Examples of an apparatus that can be generally used as an apparatus for producing toner are shown below. However, the present invention is not limited to them. Table 1, Table 2, Table 3, Table 4, and Table 5 list examples of pulverizers for toner production, examples of classifiers for toner production, examples of screening devices for toner production, examples of mixers for toner production, and examples of kneaders for toner production, respectively.

[Table 1]

TABLE 1

Examples of pulverizers for toner production

| Name of pulverizer | Manufacturer |
|---|---|
| Counter jet mill | Hosokawa Micron Corporation |
| Micron jet | Hosokawa Micron Corporation |
| IDS type mill | Nippon Pneumatic Mfg. Co., Ltd. |
| PJM jet pulverizer | Nippon Pneumatic Mfg. Co., Ltd. |
| Crossjet Mill | Kurimoto, Ltd. |
| Ulmax | Nisso Engineering Co., Ltd. |
| SK Jet-O-Mill | Seisin Enterprise Co., Ltd. |
| Kryptron | Kawasaki Heavy Industries, Ltd. |
| Turbo mill | Turbo Kogyo Co., Ltd. |
| Inomizer | Hosokawa Micron Corporation |

[Table 2]

TABLE 2

Examples of classifiers for toner production

| Name of classifier | Manufacturer |
|---|---|
| Classiel | Seisin Enterprise Co., Ltd. |
| Micron Classifier | Seisin Enterprise Co., Ltd. |
| Spedic Classifier | Seisin Enterprise Co., Ltd. |
| Turbo Classifier | Nisshin Engineering Co., Ltd. |
| Micron separator | Hosokawa Micron Corporation |
| Turboplex (ATP) | Hosokawa Micron Corporation |
| TSP Separator | Hosokawa Micron Corporation |
| Elbow-Jet | Nittetsu Mining Co., Ltd. |
| Dispersion Separator | Nippon Pneumatic Mfg. Co., Ltd. |
| YM Microcut | Yasukawa Electric Co., Ltd. |

[Table 3]

TABLE 3

Examples of screening devices for toner production

| Name of screening device | Manufacturer |
|---|---|
| Ultra Sonic | Koei Sangyo Co., Ltd. |
| Resona Sieve | Tokuju Corporation |
| Vibrasonic System | Dalton Corporation |
| Soniclean | Sintokogio Co., Ltd. |
| Gyro Sifter | Tokuju Corporation |
| circular oscillation screens | Many manufactures |
| Turbo Screener | Turbo Kogyo Co., Ltd. |
| Micro Sifter | Makino Mfg. Co., Ltd. |

[Table 4]

TABLE 4

Examples of mixers for toner production

| Name of mixer | Manufacturer |
|---|---|
| Henschel mixer | Mitsui Mining Co., Ltd. |
| Super mixer | Kawata Mfg. Co., Ltd. |
| Ribocone | Okawara Mfg. Co., Ltd. |
| Nauta mixer | Hosokawa Micron Corporation |
| Spiral pin mixer | Pacific Machinery & Engineering Co., Ltd. |
| Redige mixer | Matsubo Corporation |
| Turbulizer | Hosokawa Micron Corporation |
| Cyclomix | Hosokawa Micron Corporation |

[Table 5]

TABLE 5

Examples of kneaders for toner production

| Name of kneader | Manufacturer |
|---|---|
| KRC kneader | Kurimoto, Ltd. |
| Buss-Co-Kneader | Coperion BUSS AG |
| TEM extruder | Toshiba Machine Co., Ltd. |
| TEX biaxial kneader | Japan Steel Works, Ltd. |
| PCM kneader | Ikegai, Ltd. |
| Three roll mill | Inoue-Nissei Engineering Pte., Ltd. |
| Mixing roll mill | Inoue-Nissei Engineering Pte., Ltd. |
| Kneader | Inoue-Nissei Engineering Pte., Ltd. |
| Kneadex | Mitsui Mining Co., Ltd. |
| MS type pressurizing kneader | Moriyama Co., Ltd. |
| Kneader ruder | Moriyama Co., Ltd. |
| Banbury mixer | Kobe Steel, Ltd. |

In the present invention, pulverization is preferably performed by means of a method involving applying a mechanical impact in order to control the circularity of the toner. Examples of a treatment for applying a mechanical impact include: a method involving the use of a mechanical pulverizer such as a pulverizer KTM manufactured by Kawasaki Heavy Industries, Ltd. or a Turbo mill manufactured by Turbo Kogyo Co., Ltd.; and a method involving the use of a device such as a Mechanofusion System manufactured by Hosokawa Micron Corporation or a Hybridization System manufactured by Nara Machinery Co., Ltd. for treatment. Each of those devices may be used as it is, or may be appropriately reconstructed before use. Controlling conditions upon application of a mechanical impact enables the circularity of the toner to be controlled.

The circularity of the toner of the present invention can be adjusted by means of a specific treatment apparatus for making the shape of a toner particle nearly spherical. An apparatus capable of performing a spheroidization treatment suitable for the toner of the present invention will be specifically described with reference to the drawings.

FIG. 1 shows an example of a surface modification apparatus to be used in the present invention.

The surface modification apparatus shown in FIG. 1 includes: a casing 15; a jacket (not shown) through which cooling water or antifreeze can pass; a classification rotor 1 serving as means for classifying particles into particles each having a particle size larger than a predetermined particle size and particles each having a particle size equal to or smaller than the predetermined particle size; a dispersion rotor 6 as means for treating the surface of a particle by applying a mechanical impact to the particle; a liner 4 arranged on the outer periphery of the dispersion rotor 6 with a predetermined interval between them; a guide ring 9 as means for guiding the particles each having a particle size larger than the predetermined particle size out of the particles classified by the classification rotor 1 to the dispersion rotor 6; a discharge port 2 for fine powder collection as means for discharging the particles each having a particle size equal to or smaller than the predetermined particle size out of the particles classified by the classification rotor 1 to the outside of the apparatus; a cold air introduction port 5 as means for circulating the particles with their surfaces treated by the dispersion rotor 6 to the classification rotor 1; a raw material supply port 3 for introducing the treated particles into the casing 15; and a powder discharge port 7 having an openable/closable discharge valve 8 for discharging the particles with their surfaces treated from the casing 15.

Figure 2:
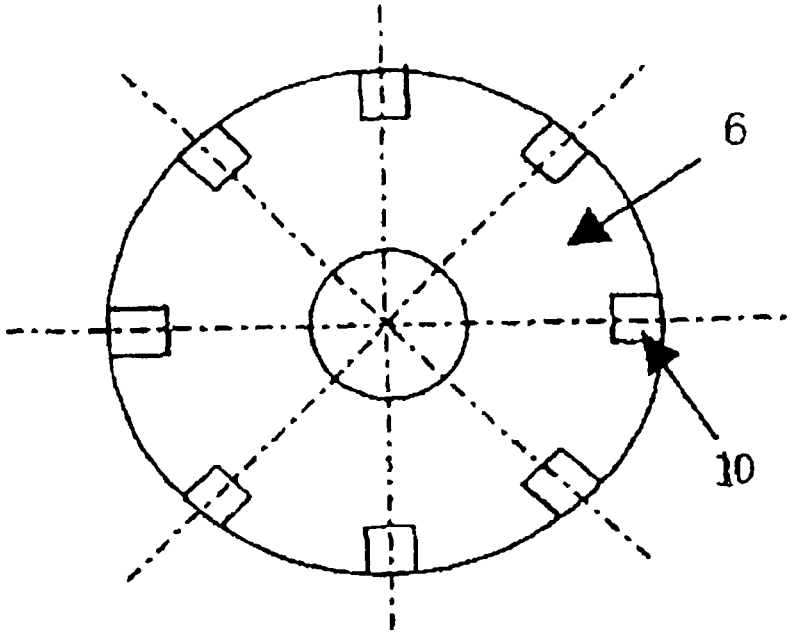
FIG. 2 is a schematic view showing a top view of a dispersion rotor shown in FIG. 1.

The classification rotor 1 is a cylindrical rotor, and is arranged on one end face side in the casing 15. The discharge port 2 for fine powder collection is arranged on one end of the casing 15 so as to discharge particles inside the classification rotor 1. The raw material supply port 3 is arranged at the center of the peripheral surface of the casing 15. The cold air introduction port 5 is arranged on the other end face side of the peripheral surface of the casing 15. The powder discharge port 7 is arranged at a position opposed to the raw material supply port 3 on the peripheral surface of the casing 15. The discharge valve 8 is a valve for freely opening and closing the powder discharge port 7. The dispersion rotor 6 and the liner 4 are arranged between the cold air introduction port 5 and each of the raw material supply port 3 and the powder discharge port 7. The liner 4 is arranged along the inner peripheral surface of the casing 15. As shown in FIG. 2, the dispersion rotor 6 has a disk and multiple square disks 10 arranged on the circumference of the disk along the normal of the disk. The dispersion rotor 6 is arranged on the other end face side of the casing 15, and is arranged at a position where a predetermined interval is formed between the liner 4 and each of the square disks 10. The guide ring 9 is arranged at the center of the casing 15. The guide ring 9 is a cylindrical body, and is arranged so as to extend from a position where the ring covers part of the outer peripheral surface of the classification rotor 1 to the vicinity of the dispersion rotor 6. The guide ring 9 forms, in the casing 15, a first space 11 as a space sandwiched between the outer peripheral surface of the guide ring 9 and the inner peripheral surface of the casing 15 and a second space 12 as a space inside the guide ring 9.

The dispersion rotor 6 may have cylindrical pins instead of the square disks 10. In this embodiment, the liner 4 is provided with a large number of grooves on its surface opposed to each of the square disks 10. Alternatively, the liner 4 may have no grooves on its surface. The classification rotor 1 may be placed vertically as shown in FIG. 1 or may be placed horizontally. Further, the number of the classification rotors 1 may be single as shown in FIG. 1 or plural.

In the surface modification apparatus constituted as described above, a predetermined amount of finely pulverized pieces are fed from the raw material supply port 3 in a state where the discharge valve 8 is closed, whereby the fed finely pulverized pieces are firstly sucked by a blower (not shown) and classified by the classification rotor 1. At this time, a fine powder having a particle size equal to or smaller than the predetermined particle size obtained as a result of the classification passes through the peripheral surface of the classification rotor 1 to be guided to the inside of the classification rotor 1, followed by being continuously discharged to the outside of the apparatus. A coarse powder having a particle size equal to or larger than the predetermined particle size rides on a circulation flow generated by the dispersion rotor 6 along the inner periphery of the guide ring 9 (the second space 12) by virtue of a centrifugal force to be guided to a gap between each of the square disks 10 and the liner 4 (which may hereinafter be referred to as the "surface modification zone"). The powder guided to the surface modification zone receives a mechanical impact force between the dispersion rotor 6 and the liner 4 to be subjected to a surface modification treatment. The particles with their surfaces modified ride on cold air passing through the inside of the apparatus, to thereby be introduced into the classification rotor 1 along the outer periphery of the guide ring 9 (the first space 11). The fine powder is discharged by the classification rotor 1 to the outside of the apparatus. The coarse powder rides on the circulation flow to return to the second space 12 again, and then repeatedly receives a surface modification action in the surface modification zone. In this way, in the surface modification apparatus shown in FIG. 1, the classification of particles by the classification rotor 1 and the treatment of the surfaces of the particles by the dispersion rotor 6 are repeated. After a predetermined time period has passed, the discharge valve 8 is opened and the particles with their surfaces modified are collected from the discharge port 7.

In such apparatus, heat causes nearly no exudation of a releasing agent. In addition, such apparatus hardly causes a releasing agent to exude to a toner particle surface owing to the appearance of a new surface as compared to the above-described conventional system that applies a mechanical impact force. Furthermore, the apparatus allows the spherization of a toner particle and the adjustment of the exudation of a releasing agent to be easily performed. Therefore, the apparatus is extremely preferable.

Methods of measuring physical properties according to the toner of the present invention are as follows. The following examples are based on these methods.

(1) Dielectric Constant and Dielectric Loss Tangent of each of Toner and Inorganic Fine Powder The dielectric constant of the magnetic toner according to the present invention is measured by means of the following method. 1 g of magnetic toner is weighed, and a load of 19,600 kPa (200 kg/cm$^2$) is applied to the toner for 2 minutes to mold the toner into a disk-like measurement sample having a diameter of 25 mm and a thickness of lmm or less (preferably 0.5 to 0.9 mm). The measurement sample is set in an ARES (manufactured by Rheometric Scientific FE Ltd.) equipped with a dielectric constant measuring jig (electrode) having a diameter of 25 mm and heated to a temperature of 80° C. for melting and fixing. After that, the temperature is cooled to 40° C., and the dielectric constant of the toner is measured in the frequency range of 500 to $5\times10^5$ Hz while a load of 1.47 N (150 g) is applied.

The dielectric constant of the inorganic fine powder according to the present invention is measured by means of the following method. 1 g of an inorganic fine powder is weighed, and a load of 19,600 kPa (200 kg/cm$^2$) is applied to the toner for 2 minutes to mold the toner into a disk-like measurement sample having a diameter of 25 mm and a thickness of 1 mm or less (preferably 0.5 to 0.9 mm). The measurement sample is set in an ARES (manufactured by Rheometric Scientific FE Ltd.) equipped with a dielectric constant measuring jig (electrode) having a diameter of 25 mm and its temperature is fixed to 40° C. Then, the dielectric constant of the inorganic fine powder is measured in the frequency range of 500 to $5\times10^5$ Hz while a load of 1.47 N (150 g) is applied.

(2) Measurement of Weight Average Particle Size (D4) of Toner

A particle size, which can be measured by means of any one of various methods, is measured by means of a Coulter Counter Multisizer in the present invention.

A Coulter Counter Multisizer II (manufactured by Beckman Coulter, Inc) is used as a measuring device, and an interface (manufactured by Nikkaki Bios Co., Ltd.) and a computer for analysis which are intended for outputting a number distribution and a volume distribution are connected to it. A 1% aqueous solution of NaCl to be used as an electrolyte is prepared by using reagent-grade or first class sodium chloride. A measurement method is as follows. 100 to 150 ml of the electrolyte are added with 0.1 to 5 ml of a surfactant (preferably alkylbenzene sulfonate) as a dispersant. Then, 2 to 20 mg of a measurement sample are added to the electrolyte. The electrolyte in which the sample is suspended is subjected to a dispersion treatment by using an ultrasonic dispersing device for about 1 to 3 minutes. After that, by using a 100-μm aperture as an aperture and the Coulter Counter Multisizer II, a toner particle size is measured. The volume and number of toner particles are measured to calculate the volume distribution and number distribution of the toner. The weight average particle size (D4) is determined from the calculated volume and number distributions.

(3) Measurement of True Specific Gravity of Toner

A measurement method of a gas replacement type by means of helium is adopted as a method of measuring the true specific gravity of the magnetic toner according to the present invention. An Accupyc 1330 (manufactured by Shimadzu Corporation) is used as a measuring device. A measurement method is as follows. 4 g of a measurement sample are fed into a stainless cell having an inner diameter of 18.5 mm, a length of 39.5 mm, and a volume of 10 cm$^3$. Next, the volume of magnetic toner in the sample cell is measured on the basis of a change in pressure of helium, and the density of the magnetic toner is determined from the measured volume and the weight of the sample.

(4) Measurement of Saturated Magnetization of Toner

The saturated magnetization of the magnetic toner is measured in an external magnetic field of 796 kA/m at room temperature (25° C.) by means of a vibration type magnetometer VSM P-1-10 (manufactured by TOEI INDUSTRY CO., LTD.).

(5) Measurement of Particle Size of Magnetic Body

The average particle size of a magnetic body is measured by means of a laser diffraction type particle size distribution meter (manufactured by HORIBA, Ltd.).

(6) Method of Measuring Softening Point of Binder Resin

The softening point of a binder resin is measured by means of a fall out type flow tester in conformance with the measurement method shown in JIS K 7210. A specific measurement method is shown below.

While 1 $cm^3$ of a sample is heated by means of a fall out type flow tester (manufactured by Shimadzu Corporation) at a rate of temperature increase of 6° C./min, a load of 1,960 $N/m^2$ (20 $kg/cm^2$) is applied to the sample by means of a plunger to extrude a nozzle having a diameter of 1 mm and a length of 1 mm. A plunger fall out amount (flow value)-temperature curve is drawn on the basis of the result of the extrusion. The height of the S-shaped curve is denoted by h, and the temperature corresponding to h/2 (the temperature at which one half of a resin flows out) is defined as a softening point.

(7) Measurement of Molecular Weight Distribution of Toner

The molecular weight of a chromatogram by GPC is measured under the following conditions.

A column is stabilized in a heat chamber at 40° C. Tetrahydrofuran (THF) as a solvent is allowed to flow into the column at the temperature at a flow rate of 1 ml/min. After a sample has been dissolved into THF, the solution is filtered through a 0.2-μm filter, and the filtrate is used as a sample. 50 to 200 μl of a THF sample solution with a sample concentration adjusted to be within the range of 0.05 to 0.6 wt % are injected for measurement. In measuring the molecular weight of the sample, the molecular weight distribution of the sample is calculated from the relationship between a logarithmic value of a calibration curve prepared by several kinds of monodisperse polystyrene standard samples and the number of counts. Examples of available standard polystyrene samples for preparing a calibration curve include samples manufactured by Pressure Chemical Co. or by Toyo Soda Manufacturing Company, Ltd. having molecular weights of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$. At least about ten standard polystyrene samples are suitably used. An RI (refractive index) detector is used as a detector.

It is recommended that multiple commercially available polystyrene gel columns be combined to be used as the column. Preferable examples of the combination include: a combination of μ-styragel 500, $10^3$, $10^4$, and $10^5$ (manufactured by Waters Corporation); and a combination of shodex KA-801, 802, 803, 804, 805, 806, and 807 (manufactured by Showa Denko K.K.).

(8) Measurement of Glass Transition Temperature of Each of Binder Resin and Toner The glass transition temperature is measured by means of a differential scanning calorimeter (a DSC measuring device) and a DSC-7 (manufactured by Perkin Elmer Co., Ltd.) in conformity with ASTM D 3418-82.

2 to 10 mg, preferably 5 mg, of measurement sample are precisely weighed. The sample is charged into an aluminum pan, and measurement is performed in the measurement temperature range of 30 to 200° C. and at a rate of temperature increase of 10° C./min at normal temperature and a normal humidity by using an empty aluminum pan as a reference. In the heating process, the endothermic main peak in the DSC curve in the range of 40 to 100° C. is obtained. The intersection of the line passing through the intermediate points of the base lines before and after the endothermic main peak and a differential thermal curve is defined as the glass transition temperature in the present invention.

(9) Measurement of Circularity of Toner

The average circularity of toner is measured by means of a flow-type particle image measuring device "FPIA-2100" (manufactured by Sysmex Corporation), and is determined from the following formula.

Circularity $c$=(Circumferential length of a circle having the same area as the particle projected area)/(Circumferential length of a particle projected image) [Formula 4]

The term "particle projected area" is defined as the area of a binarized toner particle image, while the term "circumferential length of a particle projected image" is defined as the length of a borderline obtained by connecting the edge points of the toner particle image. Measurement involves the use of the circumferential length of a particle image that has been subjected to image processing at an image processing resolution of 512×512 (a pixel measuring 0.3 μm×0.3 μm). The circularity in the present invention is an indication of the degree of irregularities on a toner particle. The circularity is 1.00 when the toner particle has a completely spherical shape. The more complicated the surface shape, the lower the circularity.

A specific measurement method is as follows. 10 ml of ion-exchanged water from which an impurity solid and the like have been removed in advance are prepared in a vessel. A surfactant (preferably alkylbenzene sulfonate) is added as a dispersant to the ion-exchanged water, and then 0.02 g of a measurement sample is added to and uniformly dispersed into the mixture to prepare a dispersion liquid. The dispersion can be performed by treating the mixture for 2 minutes by means of an ultrasonic dispersing device "Tetora 150" (manufactured by Nikkaki-Bios Co., Ltd.) to thereby prepare a dispersion liquid for measurement. At the time of the dispersion treatment, the dispersion liquid is appropriately cooled in order that the temperature of the dispersion liquid may not be 40° C. or higher. To suppress a variation in circularity, the temperature of an environment in which the flow-type particle image measuring device FPIA-2100 is placed is controlled at 23° C.±0.5° C. in such a manner that the temperature inside the device is in the range of 26 to 27° C. Automatic focusing is performed by using a 2-μm latex particle at a predetermined time interval, preferably at an interval of 2 hours.

The circularity of the toner is measured by means of the flow-type particle image measuring device, the concentration of the dispersion liquid is adjusted again in such a manner that the toner concentration at the time of the measurement is in the range of 3,000 to 10,000 particles/μm, and the circularities of 1,000 or more toner particles are measured. After the measurement, the circularity of the toner is determined by means of the data.

The measuring device "FPIA-2100", which is used in the present invention, has increased magnification of a processed particle image and increased processing resolution of a captured image (256×256 to 512×512) as compared to a measuring device "FPIA-2100", which has been conventionally used to calculate the shape of toner. Therefore, the measuring device "FPIA-2100" has increased accuracy of toner shape measurement. As a result, the measuring device "FPIA-2100" has achieved more accurate capture of a fine particle shape.

(10) The average particle size of the inorganic fine powder according to the present invention is measured by means of a transmission electron microscope. That is, the average particle size is determined by: observing an inorganic fine powder sample by means of a transmission electron microscope; and measuring the particle sizes of 100 particles in the field of view.

EXAMPLE

Hereinafter, the present invention will be described specifically by way of examples. However, the present invention is not limited to these examples.

Binder Resin Production Example 1

| | |
|---|---|
| Terephthalic acid | 27 mol % |
| Adipic acid | 15 mol % |
| Trimellitic acid | 6 mol % |
| Bisphenol derivative represented by the formula (i) (Adduct with 2.5 mol of propylene oxide) | 35 mol % |
| Bisphenol derivative represented by the formula (i) (Adduct with 2.5 mol of ethylene oxide) | 17 mol % |

The acid and alcohol components shown above and tin 2-ethylhexanoate as an esterification catalyst were fed into a four-necked flask, and a pressure reducing device, a water separating device, a nitrogen gas-introducing device, a temperature measuring device, and a stirring device were attached to the flask. The temperature of the mixture in the flask was increased to 230° C. in a nitrogen atmosphere to carry out a reaction. After the completion of the reaction, the product was taken out of the vessel, and was cooled and pulverized to produce a resin A having a softening point of 143° C. At this time, pulverizing conditions were adjusted in such a manner that the resultant pulverized pieces would have a number average particle size of 200 μm.

| | |
|---|---|
| Terephthalic acid | 24 mol % |
| Adipic acid | 16 mol % |
| Trimellitic acid | 10 mol % |
| Bisphenol derivative represented by the formula (i) (Adduct with 2.5 mol of propylene oxide) | 30 mol % |
| Bisphenol derivative represented by the formula (i) (Adduct with 2.5 mol of ethylene oxide) | 20 mol % |

Next, the acid and alcohol components shown above and an esterification catalyst were fed into a four-necked flask, and a pressure reducing device, a water separating device, a nitrogen gas-introducing device, a temperature measuring device, and a stirring device were attached to the flask. The temperature of the mixture in the flask was increased to 230° C. in a nitrogen atmosphere to carry out a reaction. After the completion of the reaction, the product was taken out of the vessel, and was cooled and pulverized to produce a resin B having a softening point of 98° C. At this time, pulverizing conditions were adjusted in such a manner that the resultant pulverized pieces would have a number average particle size of 200 μm.

50 parts by mass of the resin A and 50 parts by mass of the resin B were mixed by means of a Henschel mixer to produce a binder resin 1.

The binder resin 1 had a glass transition temperature of 59° C. and a softening point of 128° C., and contained 43 mass % of a component having a molecular weight of 10,000 or less in gel permeation chromatography.

Binder Resin Production Example 2

| | |
|---|---|
| Terephthalic acid | 30 mol % |
| Dodecenylsuccinic acid | 12 mol % |
| Trimellitic acid | 6 mol % |
| Bisphenol derivative represented by the formula (i) (Adduct with 2.5 mol of propylene oxide) | 35 mol % |
| Bisphenol derivative represented by the formula (i) (Adduct with 2.5 mol of ethylene oxide) | 17 mol % |

The acid and alcohol components shown above and an esterification catalyst were fed into a four-necked flask, and a pressure reducing device, a water separating device, a nitrogen gas-introducing device, a temperature measuring device, and a stirring device were attached to the flask. The temperature of the mixture in the flask was increased to 230° C. in a nitrogen atmosphere to carry out a reaction. After the completion of the reaction, the product was taken out of the vessel, and was cooled and pulverized to produce a resin C having a softening point of 143° C. At this time, pulverizing conditions were adjusted in such a manner that the resultant pulverized pieces would have a number average particle size of 200 μm.

| | |
|---|---|
| Terephthalic acid | 26 mol % |
| Dodecenylsuccinic acid | 10 mol % |
| Trimellitic acid | 10 mol % |
| Bisphenol derivative represented by the formula (i) (Adduct with 2.5 mol of propylene oxide) | 32 mol % |
| Bisphenol derivative represented by the formula (i) (Adduct with 2.5 mol of ethylene oxide) | 22 mol % |

Next, the acid and alcohol components shown above and an esterification catalyst were fed into a four-necked flask, and a pressure reducing device, a water separating device, a nitrogen gas-introducing device, a temperature measuring device, and a stirring device were attached to the flask. The temperature of the mixture in the flask was increased to 230° C. in a nitrogen atmosphere to carry out a reaction. After the completion of the reaction, the product was taken out of the vessel, and was cooled and pulverized to produce a resin D having a softening point of 98° C. At this time, pulverizing conditions were adjusted in such a manner that the resultant pulverized pieces would have a number average particle size of 200 μm.

70 parts by mass of the resin C and 30 parts by mass of the resin D were mixed by means of a Henschel mixer to produce a binder resin 2.

The binder resin 2 had a glass transition temperature of 57° C. and a softening point of 135° C., and contained 33% of a component having a molecular weight of 10,000 or less in gel permeation chromatography.

Binder Resin Production Example 3

| | |
|---|---|
| Terephthalic acid | 25 mol % |
| Fumaric acid | 10 mol % |
| Dodecenylsuccinic acid | 8 mol % |
| Trimellitic acid | 6 mol % |
| Bisphenol derivative represented by the formula (i) (Adduct with 2.5 mol of propylene oxide) | 30 mol % |
| Bisphenol derivative represented by the formula (i) (Adduct with 2.5 mol of ethylene oxide) | 21 mol % |

The acid and alcohol components shown above and an esterification catalyst were fed into a four-necked flask, and a pressure reducing device, a water separating device, a nitrogen gas-introducing device, a temperature measuring device, and a stirring device were attached to the flask. The temperature of the mixture in the flask was increased to 230° C. in a nitrogen atmosphere to carry out a reaction. After the completion of the reaction, the product was taken out of the vessel, and was cooled and pulverized to produce a binder resin 3. At this time, pulverizing conditions were adjusted in such a manner that the resultant pulverized pieces would have a number average particle size of 200 μm.

The binder resin 3 had a glass transition temperature of 62° C. and a softening point of 130° C., and contained 28% of a component having a molecular weight of 10,000 or less in gel permeation chromatography.

Binder Resin Production Example 4

| | |
|---|---|
| Terephthalic acid | 25 mol % |
| Dodecenylsuccinic acid | 15 mol % |
| Trimellitic acid | 8 mol % |
| Bisphenol derivative represented by the formula (i) (Adduct with 2.5 mol of propylene oxide) | 32 mol % |
| Bisphenol derivative represented by the formula (i) (Adduct with 2.5 mol of ethylene oxide) | 20 mol % |

The acid and alcohol components shown above as monomers for producing a polyester unit and tin 2-ethylhexanoate as a catalyst were fed into a four-necked flask, and a pressure reducing device, a water separating device, a nitrogen gas-introducing device, a temperature measuring device, and a stirring device were attached to the flask. While the mixture was stirred at a temperature of 130° C. in a nitrogen atmosphere, a mixture of 25 parts by mass of the following monomers for producing a styrene-acrylic resin unit and a polymerization initiator (benzoyl peroxide) was added dropwise from a dropping funnel over 4 hours to 100 parts by mass of the above monomer components for producing a polyester unit.

| | |
|---|---|
| Styrene | 83 mass % |
| 2-ethylhexyl acrylate | 15 mass % |
| Acrylic acid | 2 mass % |

The resultant was aged for 3 hours while its temperature was held at 130° C., and then its temperature was increased to 230° C. to carry out a reaction. After the completion of the reaction, the product was taken out of the vessel, and was then pulverized. After that, a polyester resin component, a vinyl-based polymer component, and a hybrid resin component having a polyester unit and a styrene-acrylic resin unit chemically bound to each other were incorporated into the pulverized product to produce a resin E having a softening point of 132° C. At this time, pulverizing conditions were adjusted in such a manner that the resultant pulverized pieces would have a number average particle size of 200 μm.

| | |
|---|---|
| Terephthalic acid | 28 mol % |
| Dodecenylsuccinic acid | 12 mol % |
| Trimellitic acid | 4 mol % |
| Bisphenol derivative represented by the formula (i) (Adduct with 2.5 mol of propylene oxide) | 30 mol % |
| Bisphenol derivative represented by the formula (i) (Adduct with 2.5 mol of ethylene oxide) | 26 mol % |

Next, the acid and alcohol components shown above as monomers for producing a polyester unit and tin 2-ethylhexanoate as a catalyst were fed into a four-necked flask, and a pressure reducing device, a water separating device, a nitrogen gas-introducing device, a temperature measuring device, and a stirring device were attached to the flask. While the mixture was stirred at a temperature of 130° C. in a nitrogen atmosphere, a mixture of 25 parts by mass of the following monomers for producing a styrene-acrylic resin unit and a polymerization initiator (benzoyl peroxide) was added dropwise from a dropping funnel over 4 hours to 100 parts by mass of the above monomer components for producing a polyester unit.

| | |
|---|---|
| Styrene | 83 mass % |
| 2-ethylhexyl acrylate | 15 mass % |
| Acrylic acid | 2 mass % |

The resultant was aged for 3 hours while its temperature was held at 130° C., and then its temperature was increased to 230° C. to carry out a reaction. After the completion of the reaction, the product was taken out of the vessel, and was then pulverized. After that, a polyester resin component, a vinyl-based polymer component, and a hybrid resin component having a polyester unit and a styrene-acrylic resin unit chemically bound to each other were incorporated into the pulverized product to produce a resin F having a softening point of 100° C. At this time, pulverizing conditions were adjusted in such a manner that the resultant pulverized pieces would have a number average particle size of 200 μm.

60 parts by mass of the resin E and 40 parts by mass of the resin F were mixed by means of a Henschel mixer to produce a binder resin 4.

The binder resin 4 had a glass transition temperature of 60° C. and a softening point of 129° C., and contained 38 mass % of a component having a molecular weight of 10,000 or less in gel permeation chromatography.

Binder Resin Production Example 5

| | |
|---|---|
| Styrene | 82 parts by mass |
| Butyl acrylate | 18 parts by mass |
| Monobutyl maleate | 0.5 part by mass |
| Di-tert-butyl peroxide | 2 parts by mass |

The above monomer compositions were mixed with 200 parts by mass of xylene heated to its reflux temperature. Solution polymerization was completed within 6 hours under xylene reflux to produce a low-molecular-weight resin solution. Meanwhile, the following monomer compositions were mixed with and suspended and dispersed into 200 parts by mass of deaerated water and 0.2 part by mass of polyvinyl alcohol.

| | |
|---|---|
| Styrene | 68 parts by mass |
| Butyl acrylate | 26 parts by mass |
| Monobutyl maleate | 6 parts by mass |
| Benzoyl peroxide | 0.1 part by mass |

The suspension dispersion liquid was heated and held at 80° C. for 24 hours in a nitrogen atmosphere to complete polymerization. The resultant was dehydrated and dried to produce a high-molecular-weight resin.

23 parts by mass of the high-molecular-weight resin were fed into the low-molecular-weight resin solution (containing 77 parts by mass of a resin content) to be completely dissolved into the solution, and the solution was mixed. After that, the solution was distilled under reduced pressure at a high temperature (180° C.) to remove the solvent. Thus, a target styrene-based copolymer composition was produced.

Magnetic Body Production Example 1

An aqueous solution mainly composed of ferrous salt containing zinc at a mass ratio Zn/Fe of zinc to iron of 0.005 was prepared. The aqueous solution was mixed with an aqueous solution of sodium hydroxide in an amount equivalent to or larger than that of each of iron and zinc to produce a ferrous hydroxide slurry. An oxidation reaction was carried out at 80° C. while the pH of the ferrous hydroxide slurry was kept at 12. The resultant slurry containing magnetite particles was subjected to a dispersion treatment by applying a mechanical shearing force to the slurry. After that, the resultant was filtered, washed, dried, and pulverized to produce a magnetic body 1.

The resultant magnetic body 1 had a number average particle size of 0.12 μm, and had a saturated magnetization of 89 $Am^2/kg$, a remanent magnetization of 11 $Am^2/kg$, and a coercive force of 12 kA/m as magnetic properties in a magnetic field of 796 kA/m.

Magnetic Body Production Example 2

An aqueous solution mainly composed of ferrous salt containing titanium at a mass ratio Ti/Fe of titanium to iron of 0.008 was prepared. The aqueous solution was mixed with an aqueous solution of sodium hydroxide in an amount equivalent to or larger than that of each of iron and titanium to produce a ferrous hydroxide slurry. An oxidation reaction was carried out at 80° C. while the pH of the ferrous hydroxide slurry was kept at 12. The resultant slurry containing magnetite particles was subjected to a dispersion treatment by applying a mechanical shearing force to the slurry. After that, the resultant was filtered, washed, dried, and pulverized to produce a magnetic body 2.

The resultant magnetic body 2 had a number average particle size of 0.25 μm, and had a saturated magnetization of 82 $Am^2/kg$, a remanent magnetization of 10 $Am^2/kg$, and a coercive force of 12 kA/m as magnetic properties in a magnetic field of 796 kA/m.

Magnetic Body Production Example 3

A magnetic body 3 was produced in the same manner as in Magnetic Body Production Example 2 except that the slurry containing magnetite particles after the oxidation reaction was not subjected to a dispersion treatment.

The resultant magnetic body 3 had a number average particle size of 0.25 μm, and had a saturated magnetization of 82 $Am^2/kg$, a remanent magnetization of 10 $Am^2/kg$, and a coercive force of 12 kA/m as magnetic properties in a magnetic field of 796 kA/m.

Magnetic Body Production Example 4

An aqueous solution mainly composed of ferrous salt containing silicon at a mass ratio Si/Fe of silicon to iron of 0.008 was prepared. The aqueous solution was mixed with an aqueous solution of sodium hydroxide in an amount equivalent to or larger than that of each of iron and silicon to produce a ferrous hydroxide slurry. An oxidation reaction was carried out at 80° C. while the pH of the ferrous hydroxide slurry was kept at 12. The resultant slurry containing magnetite particles was subjected to a dispersion treatment by applying a mechanical shearing force to the slurry. After that, the resultant was filtered, washed, dried, and pulverized to produce a magnetic body 4.

The resultant magnetic body 4 had a number average particle size of 0.08 μm, and had a saturated magnetization of 86 $Am^2/kg$, a remanent magnetization of 12 $Am^2/kg$, and a coercive force of 12 kA/m as magnetic properties in a magnetic field of 796 kA/m.

Magnetic Body Production Example 5

An aqueous solution mainly composed of ferrous salt was mixed with an aqueous solution of sodium hydroxide in an amount equivalent to or larger than that of iron to produce a ferrous hydroxide slurry. An oxidation reaction was carried out at 80° C. while the pH of the ferrous hydroxide slurry was kept at 12. The resultant slurry containing magnetite particles was filtered, washed, dried, and pulverized to produce a magnetic body 5.

The resultant magnetic body 5 had a number average particle size of 0.33 μm, and had a saturated magnetization of 78

$Am^2/kg$, a remanent magnetization of 8 $Am^2/kg$, and a coercive force of 9 kA/m as magnetic properties in a magnetic field of 796 kA/m.

Example 1

| | |
|---|---|
| Binder resin 1 | 100 parts by mass |
| Magnetic body 1 | 50 parts by mass |
| T-77 (azo-based iron compound, manufactured by Hodogaya Chemical Co., Ltd.) | 2 parts by mass |
| Polyethylene wax (manufactured by Sasol, C105, melting point 105° C.) | 3 parts by mass |

The above raw materials were mixed by means of a Henschel mixer for 3 minutes. After that, the mixture was melted and kneaded by means of a biaxial extruder PCM-30 heated to 160° C., and was then cooled with a cooling belt (containing cooling water at 15° C.). After that, the mixture was coarsely pulverized by means of a hammer mill. The resultant coarsely pulverized pieces were finely pulverized by means of a Turbo mill (manufactured by Turbo Kogyo Co., Ltd.). The resultant finely pulverized pieces were classified by means of an air classifier to produce magnetic toner base particles.

100 parts by mass of the magnetic toner base particles were externally added with 1.2 parts by mass of hydrophobic dry silica (BET 180 $m^2/g$) by means of a Henschel mixer, to thereby produce a magnetic toner 1 having a weight average particle size of 7.0 μm and containing 62.3% of particles each having a circularity of 0.93 or more as shown in Table 6 below.

The magnetic toner 1 had a glass transition temperature of 59° C., a true specific gravity of 1.56 $g/cm^3$, and a saturated magnetization of 28 $Am^2/kg$. Dielectric constant measurement at 100 kHz showed that the toner had tan δ of $6\times10^{-3}$ and a dielectric constant of 35 pF/m at 40° C. In addition, a rate of change in tan in the range of the glass transition temperature ±10° C. was 0.07.

Evaluation of Magnetic Toner

A commercially available digital copying machine IR6010 manufactured by CANON Inc. was reconstructed in such a manner that a process speed was changed from 265 mm/s to 320 mm/s and 75 sheets of A4 horizontal size paper could be fed for 1 minute. The reconstruction provided conditions under which a temperature inside the machine and a temperature near a developing unit readily increased when continuous paper feeding was performed. The toner 1 of the present invention was used in this state to perform a paper feeding duration test on 100,000 sheets in a low-temperature-and-low-humidity environment (having a temperature of 15° C. and a humidity of 10%). After that, a paper feeding duration test was performed on additional 100,000 sheets in a high-temperature-and-high-humidity environment (having a temperature of 30° C. and a humidity of 80%). After that, a paper feeding duration test was performed on additional 300,000 sheets in a normal-temperature-and-normal-humidity environment (having a temperature of 23° C. and a humidity of 50%). A chart having an image ratio of 5% was used as an original. An image Was evaluated as follows. Image deterioration upon fixation, a toner consumption, and fixability were separately measured and evaluated as follows.

Table 7 shows the respective evaluation results. As shown in Table 7, good results were obtained.

Image Evaluation

1. Image Density

The reflection densities of a 5-mm circle (1.1 density) of a chart in each environment before and after a duration test were compared by means of a Macbeth densitometer (manufactured by Gretag Macbeth) using an SPI filter, to evaluate density stability.

2. Sharpness of Digital Image

An original including a line and a letter was used. An image was visually observed and observed by means of a magnification microscope in each environment after a duration test. The image was evaluated on the basis of the following criteria.

A: Even the details of both a letter image and a line image are faithfully reproduced.

B: Slight disturbance or slight scattering occurs in a detail, but causes no problem when visually observed.

C: Disturbance or scattering is visually observed.

D: Much disturbance and scattering occur, and the original is not reproduced.

Image Deterioration Upon Fixation

A potential difference between a latent image-bearing member and a toner carrier was adjusted in a normal-temperature-and-normal-humidity environment at an early stage of paper feeding, to thereby produce an image before fixation having a width of 150 μm. The image was fixed by means of an external fixing unit obtained by removing a fixing unit from an IR6010 and attaching an external power source and an external drive to the remainder. A rate of change in line width after fixation was evaluated according to the following criteria.

A: A rate of change is 5% or less, and nearly no deterioration of an image is observed.

B: A rate of change is 5 to 10%, and no deterioration of an image is visually observed.

C: A rate of change is 10 to 20%, and the deterioration of an image is visually observed.

D: A rate of change is 20% or more, and the deterioration of an image is remarkable.

Toner Consumption

A toner consumption was determined by using the following formula from the mass of a developing unit at an early stage of an image output test in a normal-temperature-and-normal-humidity environment and the mass of the developing unit after the output of 2,000 sheets.

(Toner consumption)={(Mass of developing unit at early stage)−(Mass of developing unit after output of 2,000 sheets)}/2,000 [Formula 5]

Evaluation on Fixability

An IR6010 was placed in a low-temperature-and-low-humidity environment. An input power source was changed from 100 V as an ordinary set voltage to 80 V by means of a stabilized power source. 1,000 originals (A3 size) each having an image ratio of 5% were continuously fed in this state. In this evaluation, fixability was evaluated by performing continuous image output while performing continuous paper feeding with an input voltage set to be lower than an ordinary set value, that is, by performing the continuous image output under conditions under which the temperature of a fixing roller reduced.

A: No offset is observed even after feeding of 1,000 sheets.

B: Slight offset is observed during feeding of 800 to 1,000 sheets.

C: Offset is observed during feeding of 500 to 800 sheets.

D: Offset is observed before feeding of 500 sheets.

Examples 2 to 7

Magnetic toners 2 to 7 shown in Table 6 were each produced in the same manner as in Example 1 except that kinds of a binder resin and a magnetic body, the amounts of the binder resin and the magnetic body to be added, and a toner particle size in Example 1 were changed as shown in Table 6.

Each of the resultant magnetic toners 2 to 7 was evaluated in the same manner as in Example 1. The results shown in Table 7 were obtained.

Example 8

A magnetic toner 8 was produced in the same manner as in Example 7 except that the time period during which raw materials were mixed upon toner production in Example 7 was changed from 3 minutes to 1 minute. The time period during which raw materials were mixed was shortened to produce toner under conditions under which the dispersibility of materials became stringent.

The resultant magnetic toner 8 was evaluated in the same manner as in Example 1. The results shown in Table 7 were obtained.

Example 9

A magnetic toner 9 was produced in the same manner as in Example 7 except that the kneading temperature upon toner production in Example 7 was changed from 160° C. to 130° C. The kneading temperature was reduced to perform kneading in a state where the melting viscosity of a resin was high, to thereby produce toner under conditions under which the dispersibility of a magnetic body was more stringent.

The resultant magnetic toner 9 was evaluated in the same manner as in Example 1. The results shown in Table 7 were obtained.

Example 10

A magnetic toner 10 was produced in the same manner as in Example 7 except that the resin particle size of each of the resin C and the resin D upon mixing of the resins by means of a Henschel mixer in the production of the binder resin 2 was changed from 200 μm to 400 μm.

The resultant magnetic toner 10 was evaluated in the same manner as in Example 1. The results shown in Table 7 were obtained.

Example 11

A magnetic toner 11 was produced in the same manner as in Example 7 except that the binder resin to be used in Example 7 was changed to the binder resin 3.

The resultant magnetic toner 11 was evaluated in the same manner as in Example 1. The results shown in Table 7 were obtained.

Example 12

A magnetic toner 12 was produced in the same manner as in Example 7 except that the binder resin to be used in Example 7 was changed to the binder resin 4.

The resultant magnetic toner 12 was evaluated in the same manner as in Example 1. The results shown in Table 7 were obtained.

Example 13

The finely pulverized pieces produced in Example 1 were subjected to a surface treatment by means of a treatment apparatus shown in each of FIGS. 1 and 2 for 45 seconds at the number of revolutions of a dispersion rotor of 100 $s^{-1}$ (at a rotating peripheral speed of 130 m/sec) while fine particles were removed at the number of revolutions of a classification rotor of 120 $s^{-1}$ (after the finely pulverized product had been fed from the raw material supply port 3, the treatment was performed for 45 seconds, and then the discharge valve 8 was opened to take out the resultant as a treated product). At this time, 10 square disks were arranged on an upper portion of the dispersion rotor 6, an interval between the guide ring 9 and each of the square disks on the dispersion rotor 6 was set to 30 mm, and an interval between the dispersion rotor 6 and the liner 4 was set to 5 mm. In addition, a blower air quantity was set to 14 $m^3$/min, and the temperature of a coolant to be passed through the jacket and the cool air temperature T1 were each set to −20° C. to produce magnetic toner base particles.

100 parts by mass of the magnetic toner base particles were externally added with 1.2 parts by mass of hydrophobic dry silica (BET 180 $m^2$/g) by means of a Henschel mixer to produce a magnetic toner 13 containing 79.4% of particles having a weight average particle size of 7.0 μm and each having a circularity of 0.93 or more.

The magnetic toner 13 had a glass transition temperature of 59° C., a true specific gravity of 1.56 g/$cm^3$, and a saturated magnetization of 28 $Am^2$/kg. Dielectric constant measurement at 100 kHz showed that the toner had tan δ of $6\times10^{-3}$ at 40° C. A rate of change in tan δ in the range of the glass transition temperature ±10 was 0.07.

The resultant magnetic toner 13 was evaluated in the same manner as in Example 1. The results shown in Table 7 were obtained.

Examples 14 to 16

Magnetic toners 14 to 16 shown in Table 6 were each produced in the same manner as in Example 13 except that kinds of a binder resin and a magnetic body, the amounts of the binder resin and the magnetic body to be added, and a toner particle size in Example 13 were changed as shown in Table 6.

Each of the resultant magnetic toners 14 to 16 was evaluated in the same manner as in Example 1. The results shown in Table 7 were obtained.

Example 17

A magnetic toner 17 was produced in the same manner as in Example 7 except that the inorganic fine powder to be externally added in Example 7 was changed to the following two kinds of metal oxides.

| | |
|---|---|
| Hydrophobic dry silica (BET; 180 $m^2$/g, dielectric constant; 5) | 1.0 part by mass |
| Rutile titanium oxide having a surface treated with i-$C_4H_9Si(OCH_3)_3$ (BET; 90 $m^2$/g, dielectric constant; 118) | 0.2 part by mass |

The resultant magnetic toner 17 was evaluated in the same manner as in Example 1. The results shown in Table 7 were obtained.

Example 18

A magnetic toner 18 was produced in the same manner as in Example 7 except that the inorganic fine powder to be externally added in Example 7 was changed to the following two kinds of metal oxides.

| | |
|---|---|
| Hydrophobic dry silica (BET; 180 $m^2/g$, dielectric constant; 5) | 1.0 part by mass |
| Anatase titanium oxide having a surface treated with i-$C_4H_9Si(OCH_3)_3$ (BET; 100 $m^2/g$, dielectric constant; 48) | 0.2 part by mass |

The resultant magnetic toner 18 was evaluated in the same manner as in Example 1. The results shown in Table 7 were obtained.

Comparative Example 1

| | |
|---|---|
| Binder resin 2 | 100 parts by mass |
| Magnetic body 5 | 50 parts by mass |
| T-77 (manufactured by Hodogaya Chemical Co., Ltd.) | 2 parts by mass |
| Polyethylene wax (manufactured by Sasol, C105, melting point 105° C.) | 5 parts by mass |

The above raw materials were mixed by means of a Henschel mixer for 1 minute. After that, the mixture was melted and kneaded by means of a biaxial extruder PCM-30 heated to 130° C., and was then cooled. The cooled mixture was coarsely pulverized by means of a hammer mill. The resultant coarsely pulverized pieces were finely pulverized by means of a Turbo mill (manufactured by Turbo Kogyo Co., Ltd.). The resultant finely pulverized pieces were classified by means of an air classifier to produce magnetic toner base particles.

100 parts by mass of the magnetic toner base particles were externally added with 1.2 parts by mass of hydrophobic dry silica (BET 180 $m^2/g$) by means of a Henschel mixer, to thereby produce a comparative toner 1 having a weight average particle size of 7.5 μm as shown in Table 6.

The resultant comparative toner 1 was evaluated in the same manner as in Example 1. The results shown in Table 7 were obtained.

Comparative Example 2

A comparative toner 2 was produced by changing the binder resin in Example 7 to the binder resin 5.

The resultant comparative toner 2 was evaluated in the same manner as in Example 1. The results shown in Table 7 were obtained.

Comparative Examples 3 and 4

Comparative toners 3 and 4 shown in Table 6 were each produced in the same manner as in Comparative Example 1 except that kinds of a binder resin and a magnetic body, the amounts of the binder resin and the magnetic body to be added, and a toner particle size in Comparative Example 1 were changed as shown in Table 6.

Each of the resultant comparative toners 3 and 4 was evaluated in the same manner as in Example 1. The results shown in Table 7 were obtained.

Comparative Example 5

A comparative toner 5 shown in Table 6 was produced in the same manner as in Example 7 except that a PJM jet pulverizer (manufactured by Nippon Pneumatic Mfg. Co., Ltd.) was used for fine pulverization.

The resultant comparative toner 5 was evaluated in the same manner as in Example 1. The results shown in Table 7 were obtained.

[Table 6]

TABLE 6

| | Toner formulation | | | Toner physical properties | | | | | | | |
|---|---|---|---|---|---|---|---|---|---|---|---|
| | | Magnetic body | | Toner particle size (μm) | Glass transition point (° C.) | True specific gravity ($g/cm^3$) | Saturated magnetization ($Am^2/kg$) | Rate of change in tanδ | tanδ at 40° C. | Dielectric constant at 40° C. (pF/m) | Ratio of particles each having a circularity of 0.93 or more(%) |
| | Resin No. | Kind | Amount added | | | | | | | | |
| Magnetic toner 1 | 1 | 1 | 50 | 7.0 | 59.0 | 1.56 | 28 | 0.07 | $6 \times 10^{-3}$ | 35 | 62.3 |
| Magnetic toner 2 | 1 | 2 | 50 | 6.0 | 59.0 | 1.56 | 25 | 0.11 | $7 \times 10^{-3}$ | 32 | 60.9 |
| Magnetic toner 3 | 1 | 3 | 50 | 6.0 | 59.0 | 1.56 | 24 | 0.13 | $7 \times 10^{-3}$ | 32 | 64.0 |
| Magnetic toner 4 | 1 | 4 | 50 | 6.0 | 59.0 | 1.56 | 26 | 0.04 | $5 \times 10^{-3}$ | 38 | 63.1 |
| Magnetic toner 5 | 1 | 1 | 30 | 8.5 | 59.0 | 1.34 | 20 | 0.18 | $3 \times 10^{-3}$ | 23 | 61.4 |
| Magnetic toner 6 | 1 | 1 | 68 | 5.5 | 59.0 | 1.67 | 34 | 0.09 | $9 \times 10^{-3}$ | 39 | 70.8 |
| Magnetic toner 7 | 2 | 2 | 50 | 7.0 | 57.0 | 1.56 | 24 | 0.14 | $6 \times 10^{-3}$ | 36 | 66.6 |
| Magnetic toner 8 | 2 | 2 | 50 | 7.0 | 57.0 | 1.56 | 24 | 0.16 | $7 \times 10^{-3}$ | 36 | 62.4 |
| Magnetic toner 9 | 2 | 2 | 50 | 7.0 | 57.0 | 1.56 | 24 | 0.17 | $8 \times 10^{-3}$ | 36 | 63.8 |
| Magnetic toner 10 | 2* | 2 | 50 | 7.0 | 57.0 | 1.56 | 24 | 0.16 | $7 \times 10^{-3}$ | 36 | 70.3 |
| Magnetic toner 11 | 3 | 2 | 50 | 7.0 | 62.0 | 1.56 | 25 | 0.19 | $8 \times 10^{-3}$ | 32 | 69.2 |
| Magnetic toner 12 | 4 | 2 | 50 | 7.0 | 60.0 | 1.56 | 25 | 0.08 | $7 \times 10^{-3}$ | 29 | 64.3 |
| Magnetic toner 13 | 1 | 1 | 50 | 7.0 | 59.0 | 1.56 | 28 | 0.07 | $6 \times 10^{-3}$ | 35 | 79.4 |
| Magnetic toner 14 | 1 | 2 | 50 | 6.0 | 59.0 | 1.56 | 25 | 0.11 | $7 \times 10^{-3}$ | 32 | 81.3 |
| Magnetic toner 15 | 1 | 3 | 50 | 6.0 | 59.0 | 1.56 | 24 | 0.13 | $7 \times 10^{-3}$ | 32 | 77.2 |
| Magnetic toner 16 | 2 | 2 | 50 | 7.0 | 57.0 | 1.56 | 24 | 0.14 | $6 \times 10^{-3}$ | 36 | 83.5 |
| Magnetic toner 17 | 2 | 2 | 50 | 7.0 | 57.0 | 1.56 | 24 | 0.14 | $6 \times 10^{-3}$ | 38 | 66.8 |
| Magnetic toner 18 | 2 | 2 | 50 | 7.0 | 57.0 | 1.56 | 24 | 0.14 | $6 \times 10^{-3}$ | 37 | 67.3 |
| Comparative | 2 | 5 | 50 | 7.5 | 57.0 | 1.56 | 23 | 0.25 | $8 \times 10^{-3}$ | 34 | 67.2 |

TABLE 6-continued

| | Toner formulation | | | Toner physical properties | | | | | | | |
|---|---|---|---|---|---|---|---|---|---|---|---|
| | | Magnetic body | | Toner particle size (μm) | Glass transition point (° C.) | True specific gravity (g/cm$^3$) | Saturated magnetization (Am$^2$/kg) | Rate of change in tanδ | tanδ at 40° C. | Dielectric constant at 40° C. (pF/m) | Ratio of particles each having a circularity of 0.93 or more(%) |
| | Resin No. | Kind | Amount added | | | | | | | | |
| toner 1 | | | | | | | | | | | |
| Comparative toner 2 | 5 | 2 | 50 | 7.5 | 63.0 | 1.50 | 25 | 0.31 | $1 \times 10^{-2}$ | 19 | 62.1 |
| Comparative toner 3 | 3 | 2 | 75 | 4.8 | 62.0 | 1.72 | 34 | 0.08 | $9 \times 10^{-3}$ | 46 | 68.2 |
| Comparative toner 4 | 3 | 2 | 20 | 9.5 | 62.0 | 1.28 | 14 | 0.42 | $2 \times 10^{-3}$ | 14 | 56.5 |
| Comparative toner 5 | 2 | 2 | 50 | 7.0 | 57.0 | 1.56 | 24 | 0.14 | $6 \times 10^{-3}$ | 36 | 53.6 |

*In the magnetic toner 10, a binder resin produced by changing a resin particle size at the time of kneading to 400 μm was used.

TABLE 7

| | | Results of evaluation on developability | | | | | | | | | | | |
|---|---|---|---|---|---|---|---|---|---|---|---|---|---|
| | | Low-temperature-and-low-humidity environment | | | High-temperature-and-high-humidity environment | | | Normal-temperature-and-normal-humidity environment | | | | | |
| | | Initial | After 100,000 sheets | Sharpness | Initial | After 100,000 sheets | Sharpness | Initial | After 300,000 sheets | Sharpness | Image deterioration upon fixation | Toner consumption (mg/sheet) | Fixability |
| Example 1 | Magnetic toner 1 | 1.40 | 1.39 | A | 1.39 | 1.37 | A | 1.38 | 1.32 | B | A | 35 | B |
| Example 2 | Magnetic toner 2 | 1.41 | 1.38 | A | 1.38 | 1.35 | B | 1.36 | 1.30 | B | B | 37 | B |
| Example 3 | Magnetic toner 3 | 1.41 | 1.39 | B | 1.39 | 1.32 | C | 1.35 | 1.31 | C | B | 42 | B |
| Example 4 | Magnetic toner 4 | 1.39 | 1.38 | A | 1.38 | 1.37 | A | 1.37 | 1.28 | B | A | 34 | B |
| Example 5 | Magnetic toner 5 | 1.36 | 1.35 | B | 1.35 | 1.34 | B | 1.35 | 1.27 | C | A | 29 | A |
| Example 6 | Magnetic toner 6 | 1.42 | 1.41 | A | 1.41 | 1.39 | A | 1.39 | 1.30 | B | C | 43 | C |
| Example 7 | Magnetic toner 7 | 1.39 | 1.37 | A | 1.37 | 1.32 | B | 1.34 | 1.29 | B | B | 39 | B |
| Example 8 | Magnetic toner 8 | 1.38 | 1.37 | B | 1.37 | 1.30 | B | 1.33 | 1.24 | C | B | 40 | B |
| Example 9 | Magnetic toner 9 | 1.38 | 1.36 | B | 1.36 | 1.30 | B | 1.34 | 1.22 | C | B | 40 | B |
| Example 10 | Magnetic toner 10 | 1.38 | 1.37 | B | 1.37 | 1.30 | B | 1.35 | 1.26 | C | B | 40 | B |
| Example 11 | Magnetic toner 11 | 1.36 | 1.34 | B | 1.34 | 1.31 | C | 1.32 | 1.20 | C | C | 40 | C |
| Example 12 | Magnetic toner 12 | 1.42 | 1.41 | A | 1.41 | 1.40 | A | 1.40 | 1.26 | B | A | 35 | B |
| Example 13 | Magnetic toner 13 | 1.42 | 1.41 | A | 1.41 | 1.40 | A | 1.41 | 1.39 | A | A | 33 | B |
| Example 14 | Magnetic toner 14 | 1.42 | 1.40 | A | 1.40 | 1.37 | B | 1.37 | 1.33 | A | B | 36 | B |
| Example 15 | Magnetic toner 15 | 1.39 | 1.40 | A | 1.38 | 1.35 | A | 1.38 | 1.30 | B | B | 39 | B |
| Example 16 | Magnetic toner 16 | 1.40 | 1.39 | A | 1.39 | 1.36 | B | 1.36 | 1.32 | A | B | 35 | B |
| Example 17 | Magnetic toner 17 | 1.39 | 1.38 | A | 1.38 | 1.35 | A | 1.35 | 1.30 | A | A | 34 | B |
| Example 18 | Magnetic toner 18 | 1.39 | 1.37 | A | 1.37 | 1.34 | B | 1.34 | 1.29 | B | B | 37 | B |
| Comparative Example 1 | Comparative toner 1 | 1.40 | 1.38 | B | 1.38 | 1.31 | C | 1.31 | 1.12 | D | D | 46 | B |
| Comparative Example 2 | Comparative toner 2 | 1.35 | 1.30 | C | 1.30 | 1.24 | C | 1.24 | 1.08 | D | D | 44 | C |
| Comparative Example 3 | Comparative toner 3 | 1.42 | 1.40 | A | 1.40 | 1.34 | B | 1.34 | 1.11 | C | D | 50 | D |
| Comparative Example 4 | Comparative toner 4 | 1.37 | 1.34 | C | 1.34 | 1.30 | D | 1.30 | 1.03 | D | C | 33 | A |
| Comparative Example 5 | Comparative toner 5 | 1.38 | 1.36 | B | 1.36 | 1.32 | B | 1.32 | 1.14 | D | B | 38 | B |

INDUSTRIAL APPLICABILITY

According to the present invention, there can be provided a magnetic toner which: enables a stable image density to be obtained irrespective of a use environment; and exhibits excellent low-temperature fixability, little image deterioration upon fixation, high coloring power, and a reduced toner consumption.

The invention claimed is:

1. A magnetic toner comprising magnetic toner base particles each containing at least a binder resin and magnetic iron oxide, wherein:

(i) the binder resin contains a polyester unit;

(ii) the toner has a weight average particle size (D4) of 5.0 to 9.0 μm;

(iii) the toner has a true specific gravity of 1.34 to 1.56 g/cm$^3$;

(iv) the toner has a saturated magnetization of 20 to 35 Am$^2$/kg in a magnetic field of 796 kA/m;

(v) the toner contains 60 number % or more of toner having a circularity of 0.93 or more; and (vi) a dielectric loss tangent (tan δ) of the toner at 100 kHz satisfies the following formula (I):

$$(\tan \delta_H - \tan \delta_L)/\tan \delta_L < 0.20 \quad (1)$$

wherein tan $\delta_H$ represents a dielectric loss tangent of the toner at a glass transition temperature (° C.)+10° C. and tan $\delta_L$ represents a dielectric loss tangent of the toner at the glass transition temperature (° C.)−10° C.

2. A magnetic toner according to claim 1, wherein the toner contains 75 number % or more of toner having a circularity of 0.95 or more.

3. A magnetic toner according to claim 1 or 2, wherein a dielectric loss tangent (tan δ) of the toner at 100 kHz and 40° C. is $2\times10^{-3}$ to $1\times10^{-2}$.

4. A magnetic toner according to claim 1 or 2, wherein a dielectric constant of the toner at 100 kHz and 40° C. is 15 to 40 (pF/m).

5. A magnetic toner according to claim 1 or 2, wherein the magnetic iron oxide has a number average particle size of 0.08 to 0.30 μm.

6. A magnetic toner according to claim 1 or 2, further comprising 30 mass % or more of a component having a molecular weight of 10,000 or less in a molecular weight distribution of the toner.

7. A magnetic toner according to claim 1 or 2, wherein the binder resin contains two or more kinds of resins different from each other in softening point.

* * * * *